US010542813B2

(12) United States Patent
Ohba

(10) Patent No.: US 10,542,813 B2
(45) Date of Patent: Jan. 28, 2020

(54) CARTRIDGE-TYPE COSMETIC CONTAINER

(71) Applicant: SUZUNO KASEI KABUSHIKI KAISHA, Tokyo (JP)

(72) Inventor: Atsushi Ohba, Tokyo (JP)

(73) Assignee: SUZUNO KASEI KABUSHIKI KAISHA, Tokyo (JP)

( * ) Notice: Subject to any disclaimer, the term of this patent is extended or adjusted under 35 U.S.C. 154(b) by 47 days.

(21) Appl. No.: 15/748,703

(22) PCT Filed: Jul. 29, 2016

(86) PCT No.: PCT/JP2016/072399
§ 371 (c)(1),
(2) Date: Jan. 30, 2018

(87) PCT Pub. No.: WO2017/026305
PCT Pub. Date: Feb. 16, 2017

(65) Prior Publication Data

US 2019/0000216 A1 Jan. 3, 2019

(30) Foreign Application Priority Data

Aug. 7, 2015 (JP) ..... 2015-157546

(51) Int. Cl.

| | |
|---|---|
| ***A45D 40/04*** | (2006.01) |
| ***A45D 40/10*** | (2006.01) |
| ***A45D 40/20*** | (2006.01) |
| *B43K 21/08* | (2006.01) |
| *A45D 40/00* | (2006.01) |

(52) U.S. Cl.
CPC ..... *A45D 40/10* (2013.01); *A45D 40/04* (2013.01); *A45D 40/20* (2013.01); *A45D 40/205* (2013.01); *A45D 2040/0025* (2013.01); *A45D 2040/204* (2013.01); *A45D 2040/208* (2013.01); *B43K 21/08* (2013.01)

(58) Field of Classification Search
CPC ..... A45D 40/04; B43K 21/08
USPC ..... 401/68, 70, 164
See application file for complete search history.

(56) References Cited

U.S. PATENT DOCUMENTS

2015/0030370 A1* 1/2015 Tani ..... A45D 40/04 401/74

FOREIGN PATENT DOCUMENTS

JP 2014-161637 A 9/2014

* cited by examiner

*Primary Examiner* — David J Walczak
*Assistant Examiner* — Joshua R Wiljanen
(74) *Attorney, Agent, or Firm* — Rabin & Berdo, P.C.

(57) ABSTRACT

A cartridge-type cosmetic container includes a body tube to which a cartridge body is detachably attached, a driving body relatively rotatably provided in the body tube, a push rod formed with an external thread on an outer periphery, an internal thread member provided on an outer periphery of the push rod, an internal thread portion formed in the internal thread member and configured to be threadably engaged with the external thread by pressing the internal thread member by the cartridge body, and a biasing member configured to bias the internal thread member, wherein the body tube includes a limiting portion configured to limit a movement of the push rod in a direction to threadably disengage the internal thread portion of the internal thread member and the external thread of the push rod.

14 Claims, 22 Drawing Sheets

CARTRIDGE-TYPE COSMETIC CONTAINER

TECHNICAL FIELD

The present invention relates to a cartridge-type cosmetic container to which a cartridge body storing a cosmetic is to be detachably attached.

BACKGROUND ART

Conventionally, a cartridge-type cosmetic container is used which finely moves a cosmetic in a cartridge body out from a front end opening hole of the cartridge body. In some of cartridge-type cosmetic containers, a cartridge body is provided with no feeding mechanism and a feeding mechanism is provided completely separately from and independently of the cartridge body.

JP2014-161637A discloses a cartridge-type cosmetic container including a push rod formed with an external thread on an outer periphery, a pair of piece bodies each formed on an inner periphery with an internal thread to be threadably engaged with the external thread with a cartridge body attached to a body tube, and a coil spring configured to abut on the pair of the piece bodies. When the cartridge body is detached from the body tube, the pair of piece bodies is moved in an axial direction by a biasing force of the coil spring. At this time, the pair of piece bodies is guided in a direction to be separated from the push rod by a separation guide portion provided on the inner periphery of the body tube. As a result, the internal threads of the piece bodies and the external thread of the push rod are threadably disengaged and the push rod moves to a feed retreat limit.

Further, the cartridge-type cosmetic container disclosed in JP2014-161637A includes a proximity guide portion for guiding the pair of piece bodies in a direction to approach the push rod when the cartridge body is attached to the body tube. Since the pair of piece bodies approaches the push rod to sandwich the push rod, a movement of the push rod in a direction to threadably disengage the internal threads of the pair of piece bodies and the external thread of the push rod is limited by the pair of piece bodies.

SUMMARY OF INVENTION

However, in the cartridge-type cosmetic container disclosed in JP2014-161637A, one piece body may move while being shifted from the other in the body tube when the cartridge body is attached to the body tube. In this case, the one piece body may be inclined with respect to the axial direction of the cartridge-type cosmetic container and an abutting surface of the piece body on which the coil spring abuts may be inclined with respect to the axial direction. Due to the inclination of the abutting surface, the biasing force of the coil spring is applied to the one piece body in a biased manner and a biasing force larger than normal may possibly act on the one piece body.

Further, if the one piece body moves while being shifted from the other in the body tube, the pair of piece bodies may be possibly held in a state where top parts of the internal threads are abutting on a top part of the external thread without the internal threads being threadably engaged with the external thread of the push rod. If a biasing force larger than normal acts on the piece body in this state, it becomes difficult to insert the cartridge body into the body tube and it may become impossible to insert the cartridge body to a predetermined position in the body tube. As a result, a movement of the push rod in the direction to threadably disengage the internal threads of the pair of piece bodies and the external thread of the push rod is not limited by the pair of piece bodies and the threadable engagement of the internal threads and the external thread may possibly become weak.

The present invention aims to provide a cartridge-type cosmetic container capable of reliably feeding out a cosmetic.

The present invention relates to a cartridge-type cosmetic container used with a cartridge body storing a cosmetic attached thereto. According to one aspect of the present invention, the cartridge-type cosmetic container includes a body tube to which the cartridge body is detachably attached, a driving body relatively rotatably provided in the body tube, a push rod formed with an external thread on an outer periphery, the push rod being configured to push out the cosmetic in the cartridge body by being fed out by relative rotation of the body tube and the driving body, an internal thread member provided on an outer periphery of the push rod, an internal thread portion formed in the internal thread member, the internal thread portion being configured to be threadably engaged with the external thread by pressing the internal thread member by the cartridge body when the cartridge body is attached to the body tube, and a biasing member configured to bias the internal thread member in a direction toward a front end opening of the body tube, wherein the body tube includes a limiting portion configured to limit a movement of the push rod in a direction to threadably disengage the internal thread portion and the external thread.

DESCRIPTION OF EMBODIMENTS

Hereinafter, embodiments of the present invention are described with reference to the drawings.

(First Embodiment)

A cartridge-type cosmetic container according to a first embodiment of the present invention is described with reference to FIGS. 1A to 11E.

Figure 1A:
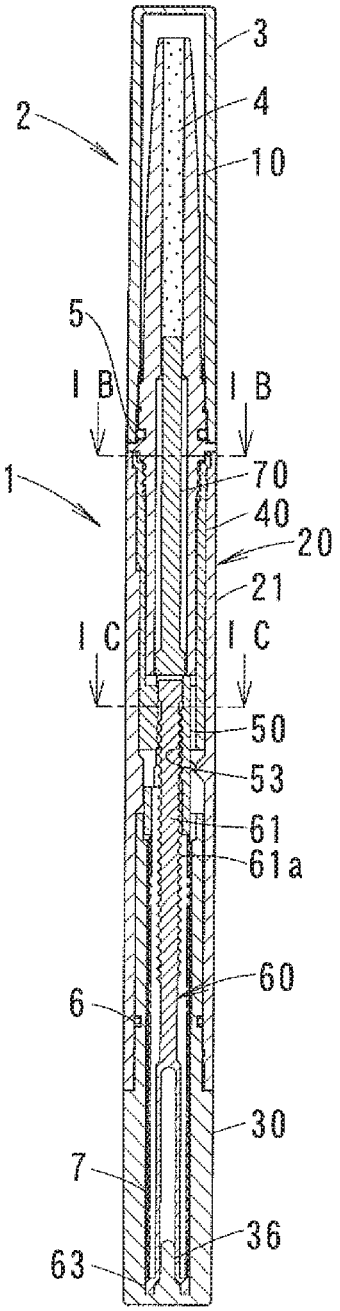
FIG. 1A is a front sectional view of a cartridge-type cosmetic container according to a first embodiment of the present invention.
Figure 1B:
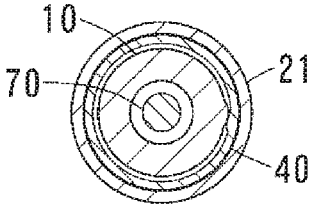
FIG. 1B is a sectional view along IB-IB in FIG. 1A.
Figure 1C:
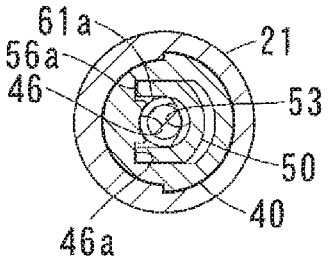
FIG. 1C is a sectional view along IC-IC in FIG. 1A.
Figure 2:
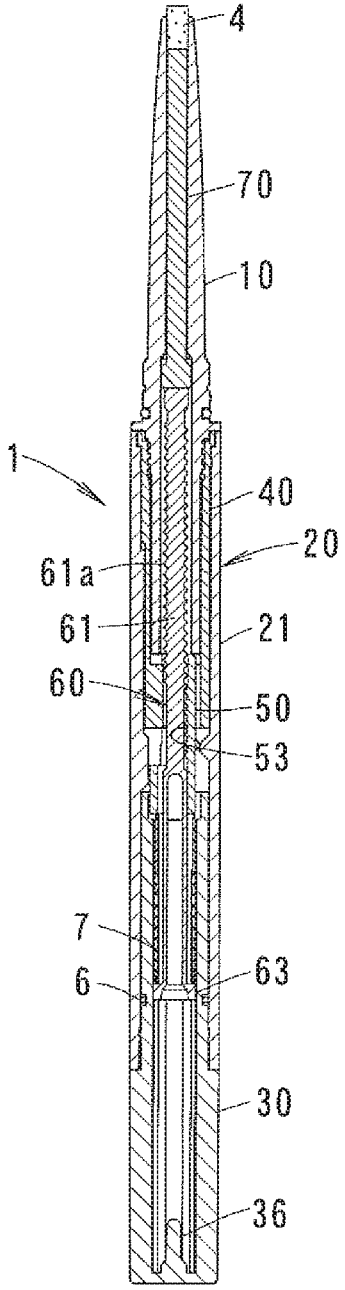
FIG. 2 is a front sectional view showing a feed upper limit of the cartridge-type cosmetic container according to the first embodiment of the present invention.
Figure 3A:
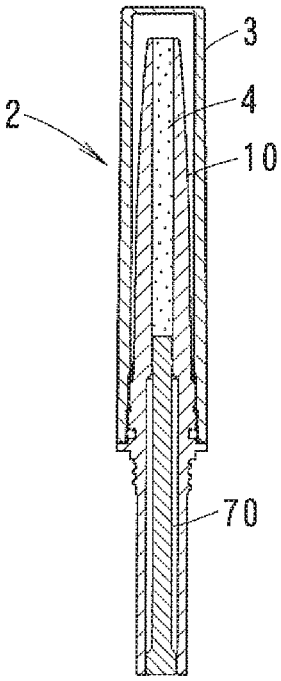
FIG. 3A is a sectional view of a cartridge body.
Figure 3B:
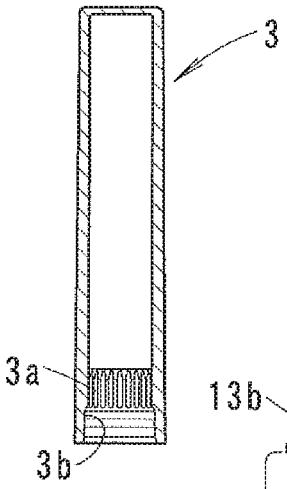
FIG. 3B is a front sectional view of a cap.
Figure 3C:
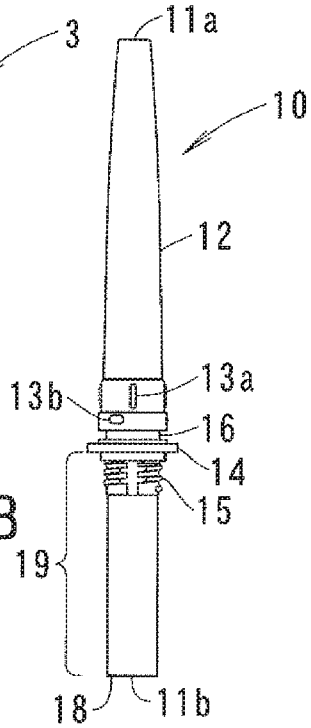
FIG. 3C is a front view of a cartridge outer tube.
Figure 3D:
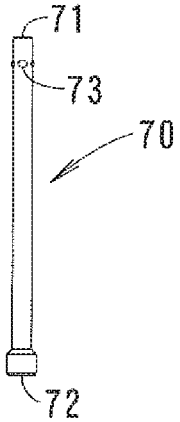
FIG. 3D is a front view of a holding member.
Figures 4A, 4B, 4C:
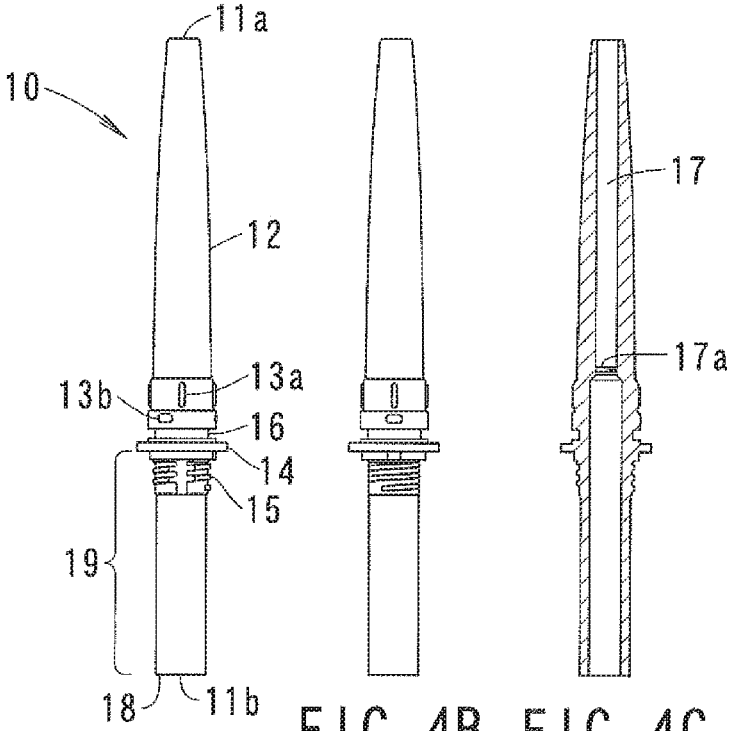
FIG. 4A is a front view of the cartridge outer tube.
FIG. 4B is a side view of the cartridge outer tube.
FIG. 4C is a front sectional view of the cartridge outer tube.

First, an entire configuration of the cartridge-type cosmetic container 1 is described with reference to FIGS. 1A to 2.

The cartridge-type cosmetic container 1 is used with a cartridge body 2 storing a cosmetic 4 attached thereto. As shown in FIGS. 1A to 1C, the cartridge-type cosmetic container 1 includes a body tube 20 to which the cartridge body 2 is detachably attached, a driving body 30 which is coaxially and relatively rotatably attached to the body tube 20, a push rod 60 which is formed with an external thread 61*a* on an outer periphery and pushes out the cosmetic 4 in the cartridge body 2 by being fed out by relative rotation of the body tube 20 and the driving body 30 and an internal thread member 50 which is formed on an inner periphery with an internal thread portion 53 to be threadably engaged with the external thread 61*a* with the cartridge body 2 attached to the body tube 20. The body tube 20 includes a body outer tube 21 to which the driving body 30 is relatively rotatably attached, and a body inner tube 40 which is inserted into the inner periphery of the body outer tube 21.

Further, the cartridge-type cosmetic 1 includes a coil spring 7 serving as a biasing member for biasing the internal thread member 50 and the push rod 60. Each component for feeding out the cosmetic 4 is aggregated in the cartridge-type cosmetic container 1 without being provided in the cartridge body 2.

The cartridge body 2 to be attached to the cartridge type cosmetic container 1 is described with reference to FIGS. 1A to 1C, 3A to 3D and 4A to 4C.

The cartridge body 2 is threadably engaged with the body tube 20. The cartridge body 2 includes a cartridge outer tube 10 for storing the cosmetic 4, a holding member 70 slidable in an axial direction on the inner periphery of the cartridge outer tube 10 and a cap 3 to be attached to the cartridge outer tube 10.

The cartridge outer tube 10 includes a cosmetic storing portion 12, a fitting portion 19 to be fitted into the body tube 20 and a flange 14 projecting on an outer periphery between the cosmetic storing portion 12 and the fitting portion 19. A front end opening 11*a* is formed in the tip of the cosmetic storing portion 12. A rear end opening 11*b* is formed in the rear end of the fitting portion 19.

The cosmetic storing portion 12 is formed into a substantially cylindrical shape. The cosmetic 4 is stored in the inner periphery of the cosmetic storing portion 12. The cosmetic storing portion 12 is provided with a rib 13*a*, a fitting projection 13*b* and an O-ring groove 16 on the outer periphery thereof. The rib 13*a* is engaged with a knurled part 3*a* provided on the inner periphery of the cap 3 to lock the cap 3 in a circumferential direction when the cap 3 is attached to the cartridge outer tube 10. The fitting projection 13*b* is fitted into a fitting recess 3*b* provided on the inner periphery of the cap 3 to lock the cap 3 in the axial direction when the cap 3 is attached to the cartridge outer tube 10. An O-ring 5 is mounted into the O-ring groove 16.

The fitting portion 19 is formed into a substantially cylindrical shape. The inner periphery of the fitting portion 19 is formed to be continuous with the inner periphery of the cosmetic storing portion 12. An external thread 15 is formed in the axial direction from the flange 14 on the outer periphery of the fitting portion 19. The external thread 15 is to be threadably engaged with the body tube 20.

The flange 14 defines the position of the cartridge outer tube 10 in the axial direction by contacting an end part of the body tube 20 when the cartridge outer tube 10 is attached to the body tube 20. Further, the flange 14 defines the position of the cap 3 in the axial direction by contacting an end surface of the cap 3 when the cap 3 is attached to the cartridge outer tube 10.

The holding member 70 is formed into a substantially cylindrical shape and inserted into a through hole 17 penetrating through the cartridge outer body 10 in the axial direction. The holding member 70 is located at the rear end of the cosmetic 4. The holding member 70 includes a ceiling surface 71 to be held in contact with the cosmetic 4, a rear end surface 72 provided on a side opposite to the ceiling surface 71 and a protrusion 73 formed on an outer periphery.

When the cartridge outer tube 10 is attached to the body tube 20 and the push rod 60 is fed out by relative rotation of the body tube 20 and the driving body 30, a ceiling surface 62 of the push rod 60 abuts on the rear end surface 72 of the holding member 70.

The cosmetic 4 is filled through the front end opening 11*a* in a state where the holding member 70 is inserted into the inner periphery of the cartridge outer tube 10 and the protrusion 73 of the holding member 70 moves over an annular projection 17*a* provided on the inner periphery of the cartridge outer tube 10 to prevent downward detachment of the holding member 70. The cosmetic 4 is heated into a liquid state when being filled, and formed into a bar-like shape by being cooled after filling.

The cap 3 is formed into a bottomed cylindrical shape. The cap 3 is attached to the cosmetic storing portion 12 of the cartridge outer tube 10 to close the front end opening 11*a*. The cap 3 is provided, on the inner periphery of an opening end thereof, with the knurled part 3*a* to be engaged with the rib 13*a* of the cartridge outer tube 10 and the annular fitting recess 3*b* to be fitted to the fitting projection 13*b* of the cartridge outer tube 10.

The O-ring 5 is mounted into the O-ring groove 16 provided in the cartridge outer tube 10. With the cap 3 attached to the cartridge outer tube 10, the O-ring 5 closes a clearance between the cartridge outer tube 10 and the cap 3 to prevent the interior of the cap from being dried.

The cartridge body 2 configured as just described is sold alone as a cartridge with the built-in cosmetic 4 by attaching the cap 3 to the cartridge outer tube 10 having the holding member 70 inserted thereinto and storing the cosmetic 4 to close the front end opening 11*a*. Instead of this, the cartridge-type cosmetic container 1 with the cartridge body 2 may be sold with the cartridge body 2 attached to the cartridge-type cosmetic container 1.

Next, the cartridge-type cosmetic container 1 is described with reference to FIGS. 5A to 11E.

As shown in FIGS. 5A to 6B, the body outer tube 21 is formed into a substantially cylindrical shape having a front end opening 22 and a rear end opening 29. The body inner tube 40 is inserted into the inner periphery of the body outer tube 21 through the front end opening 22. The driving body 30 is inserted into the inner periphery of the body outer tube 21 through the rear end opening 29.

The body outer tube 21 includes an annular fitting recess 23 to be fitted to the body inner tube 40 on the inner periphery near the front end opening 22. The body outer tube 21 includes an annular fitting recess 28 to be relatively rotatably fitted to the driving body 30 on the inner periphery near the rear end opening 29.

The body outer tube 21 is provided on the inner periphery thereof with proximity guide portions (first guide portion) 25 and a guide wall portion 26. The proximity guide portions 25 are formed to project radially inward substantially in an axial center of the body outer tube 21. The guide wall portion 26 is formed to project radially inward in a region from a substantially center between the front end opening 22 and the proximity guide portions 25 to the proximity guide portions 25.

The guide wall portion 26 is engaged with a guide portion 45 provided on the outer periphery of the body inner tube 40. The position of the body inner tube 40 in the circumferential direction with respect to the body outer tube 21 is defined and relative rotation of the body outer tube 21 and the body inner tube 40 is disabled by the guide wall portion 26 and the guide portion 45. As just described, the body inner tube 40 is guided to be non-rotatable when the body inner tube 40 is inserted into the inner periphery of the body outer tube 21.

A pair of the proximity guide portions 25 is provided to face each other in a radial direction. Each proximity guide portion 25 includes an inclined surface 25*a* inclined with respect to the axial direction. The inclined surface 25*a* of the proximity guide portion 25 is in contact with a rear end surface 55*b* of a later-described blade portion 55 of the internal thread member 50 when the cartridge outer tube 10 is attached to the body tube 20. Since the inclined surfaces 25*a* are inclined with respect to the axial direction, the internal thread member 50 moves in the axial direction together with the cartridge outer tube 10 and moves toward a radial center.

As shown in FIGS. 5A to 5C and 7A to 7C, the driving body 30 is formed into a bottomed substantially cylindrical shape. The driving body 30 includes a fitting portion 31 to be fitted into the body outer tube 21 and a grip portion 32 formed to be continuous with the fitting portion 31 and used by being gripped by a user.

The fitting portion 31 is formed into a substantially cylindrical shape. A fitting recess 34 to be fitted to the fitting projection 28 of the body outer tube 21 is annularly formed on the outer periphery of the fitting portion 31 near a base end (near the grip portion 32). Further, an annular O-ring groove 33 is formed on the outer periphery of the fitting portion 31. By mounting an O-ring 6 into this O-ring groove 33, suitable resistance can be applied to relative rotation of the body outer tube 21 and the driving body 30, whereby an operation feeling by the user can be improved.

The grip portion 32 is formed to have a larger diameter than the fitting portion 31. The grip portion 32 is formed to have a diameter substantially equal to an outer diameter of the body outer tube 21. This causes the outer peripheral surface of the body outer tube 21 and that of the grip portion 32 to be substantially flush with each other when the driving body 30 is assembled with the body outer tube 21.

Further, the driving body 30 is provided with a plurality of grooves 35 to be relatively unrotatably engaged with the push rod 60 and a support column 36 for holding the push rod 60 when the cartridge-type cosmetic container 1 is assembled.

The grooves 35 extend in the axial direction from a bottom surface 37 of the inner periphery of the driving body 30 to a front end opening 39. The grooves 35 are engaged with ribs 63*b* of a later-described large-diameter portion 63 of the push rod 60 to disable relative rotation with respect to the push rod 60. Four grooves 35 are provided in the present embodiment.

The support column 36 is formed into a substantially cylindrical shape and projects in the axial direction from the bottom surface 37 of the inner periphery. The tip of the support column 36 is rounded into a semispherical shape to facilitate insertion into a later-described cavity portion 64 of the push rod 60.

As shown in FIGS. 5A to 5C and 8A to 8C, the push rod 60 is formed into a substantially cylindrical shape. The push rod 60 is accommodated into the body tube 20 and the inner periphery of the driving body 30. The push rod 60 includes a rod shaft 61 provided coaxially with the body tube 20 and the driving body 30, the ceiling surface 62 provided on one end of the rod shaft 61, the large-diameter portion 63 provided on the other end of the rod shaft 61 and the cavity portion 64 recessed from the large-diameter portion 63 in the axial direction.

The external thread 61*a* is formed on the outer periphery of the rod shaft 61. The cosmetic 4 (see FIGS. 1A to 1C and the like) stored in the cartridge body 2 is used by a very small amount thereof being pushed out every time. Thus, the pitch of the external thread 61*a* is set at such a pitch that the push rod 60 is capable of making a fine movement.

The later-described internal thread portion 53 of the internal thread member 50 is threadably engageable with the external thread 61*a*. A stroke of the push rod 60 is determined by an axial length of the external thread 61*a*.

The ceiling surface 62 abuts on the rear end surface 72 (see FIGS. 3A to 3D) of the holding member 70 of the cartridge body 2 when the push rod 60 is fed out with the cartridge body 2 attached to the cartridge-type cosmetic container 1. When the push rod 60 is fed out, the ceiling surface 62 presses the holding member 70, whereby the cosmetic 4 in the cartridge outer tube 10 is pushed out from the front end opening 11*a*.

The large-diameter portion 63 is formed into a disk shape having a larger diameter than the rod shaft 61. The large-diameter portion 63 is provided with a coil spring placing portion 63*a* on which the coil spring 7 is placed, and a rear end surface 63*c* formed on a side opposite to the coil spring placing portion 63*a*. The large-diameter portion 63 moves in the axial direction in the driving body 30. The large-diameter portion 63 defines a feed lower limit of the push rod 60 when the rear end surface 63*c* contacts the bottom surface 37 of the driving body 30.

A plurality of the ribs 63*b* to be slidably engaged with the grooves 35 (see FIGS. 7A to 7C) of the driving body 30 are formed on the outer periphery of the large-diameter portion 63. By the engagement of the ribs 63*b* with the grooves 35 of the driving body 30, relative rotation of the push rod 60 and the driving body 30 is disabled. Thus, if the user grips and rotates the driving body 30, the push rod 60 rotates in synchronization with the driving body 30.

It should be noted that the push rod 60 is designed for the purpose of causing the cosmetic 4 (see FIGS. 1A to 1C and the like) in the cartridge body 2 to finely move out. Thus, in the present embodiment, the fed-out cosmetic 4 cannot be fed back into the cartridge outer tube 10 even if the push rod 60 is moved backward.

The cavity portion 64 is formed into a shape corresponding to the support column 36 (see FIGS. 7A to 7C) of the driving body 30. The cavity portion 64 is formed to be longer than the support column 36. In this way, the support column 36 can be inserted into the cavity portion 64 when the cartridge-type cosmetic container 1 is assembled.

As shown in FIGS. 5A to 5C and 9, the coil spring 7 is arranged between the coil spring placing portion 63*a* and the internal thread member 50 such that the rod shaft 61 is inserted into the inner periphery of the coil spring 7. A free length (means a length in a state where no load is applied) of the coil spring 7 is longer than a distance between the coil spring placing portion 63*a* of the push rod 60 located at the feed lower limit and the internal thread member 50. Thus, with the cartridge-type cosmetic container 1 assembled, the coil spring 7 biases the push rod 60 and the internal thread member 50 in directions to separate the large-diameter portion 63 and the internal thread member 50 from each other.

As shown in FIGS. 5A to 5C and 10A to 10D, the body inner tube 40 is formed into a substantially cylindrical shape having a front end opening 41 and a rear end opening 48. The fitting portion 19 (see FIGS. 3A to 3D and the like) of the cartridge outer tube 10 is inserted into the inner periphery of the body inner tube 40 through the front end opening 41. The internal thread member 50 is inserted into the inner periphery of the body inner tube 40 through the rear end opening 48.

The body inner tube 40 is provided with an internal thread 43 formed in the axial direction from the front end opening 41 on the inner periphery, the guide portion 45 formed by recessing the outer periphery and separation guide portions (second guide portion) 44 formed on the inner periphery near the rear end opening 48. The body inner tube 40 includes an annular fitting projection 42 to be fitted into the fitting recess 23 (see FIGS. 6A and 6B) of the body outer tube 21 on the outer periphery near the front end opening 41.

The internal thread 43 is formed to correspond to the external thread 15 (see FIGS. 3A to 3D) of the cartridge outer tube 10. By the threadable engagement of the internal thread 43 and the external thread 15, the cartridge outer tube 10 is fixed to the body inner tube 40.

The guide portion 45 extends in the axial direction from the rear end surface 47. The guide portion 45 is formed at a position corresponding to the guide wall portion 26 (see FIGS. 6A and 6B) of the body outer tube 21 and engaged with the guide wall portion 26. In this way, relative rotation of the body outer tube 21 and the body inner tube 40 is disabled.

A pair of the separation guide portions 44 are formed to correspond to the proximity guide portions 25 (see FIGS. 6A and 6B) of the body outer tube 21. The separation guide portions 44 are formed parallel to the proximity guide portions 25. Further, the separation guide portions 44 are located closer to the front end opening 22 of the body outer tube 21 than the proximity guide portions 25 with predetermined clearances formed between the separation guide portions 44 and the proximity guide portions 25. These clearances are formed to have such a size that the later-described blade portions 55 of the internal thread member 50 are insertable.

Each separation guide portion 44 is formed into a projection shape having an inclined surface 44*a* inclined with respect to the axial direction, and a side surface 44*b* extending along the axial direction and projects radially inward.

The inclined surfaces 44*a* of the separation guide portions 44 contact front end surfaces 55*a* of the blade portions 55 of the internal thread member 50 when the cartridge outer tube 10 is detached from the body tube 20 and the internal thread member 50 is moved in the axial direction by a biasing force of the coil spring 7. Since the inclined surfaces 44*a* are inclined with respect to the axial direction, the internal thread member 50 is moved in the axial direction by the biasing force of the coil spring 7 and moves in a radial direction to separate from a center.

Further, the body inner tube 40 includes a projecting wall portion 46 projecting from the inner peripheral surface of the body inner tube 40 and step portions 49 provided on the inner periphery of the body inner tube 40. The projecting wall portion 46 is formed to project radially inward. Recesses 46*a* are formed at both sides of the projecting wall portion 46 in the circumferential direction. The step portion 49 is formed by the separation guide portion 44 and located on a side opposite to the inclined surface 44*a*.

As shown in FIGS. 5A to 5C and 11A to 11E, the internal thread member 50 includes a body portion 51 to be arranged in a part of the outer periphery of the push rod 60 and an inserting portion 52 having a hole 52*a* through which the push rod 60 is inserted. A part of the inserting portion 52 is formed to be continuous in the axial direction from the body portion 51.

The coil spring 7 abuts on a rear end surface (rear end surface of the inserting portion 52) 50*b* of the internal thread member 50. By the action of the biasing force of the coil spring 7 on the rear end surface 50*b*, the internal thread member 50 is biased in a direction to be separated from the large-diameter portion 63 of the push rod 60 (direction toward the front end opening 41 of the body inner tube 40).

The rear end surface 50*b* of the internal thread member 50 is annularly formed. Thus, the coil spring 7 abuts on the rear end surface 50*b* over the entire circumference and the biasing force of the coil spring 7 acts on the internal thread member 50 in an unbiased manner. Thus, the internal thread member 50 can be prevented from being inclined with respect to the axial direction.

A front end surface (front end surface of the body portion 51) 50*a* of the internal thread member 50 is in contact with the rear end surface 18 of the cartridge outer tube 10 with the cartridge outer tube 10 attached to the body tube 20. That is, the internal thread member 50 is pressed by the cartridge outer tube 10 and moves together with the cartridge outer tube 10 while compressing and contracting the coil spring 7 when the cartridge outer tube 10 is attached to the body tube 20.

The coil spring 7 biases the internal thread member 50 in the direction toward the front end opening 41 of the body inner tube 40 (direction opposite to a pressing direction by the cartridge outer tube 10). Thus, the internal thread member 50 is moved together with the cartridge outer tube 10 by an upward biasing force of the coil spring 7 when the cartridge outer tube 10 is detached from the body tube 20 and the pressing of the internal thread member 50 by the cartridge outer tube 10 is released.

The body portion 51 includes a base portion 51*a* formed to have an arcuate cross-section and a pair of extending portions 51*b* extending parallel to each other from both ends of the base portion 51*a* in the circumferential direction. The extending portion 51*b* is provided with an opening end surface 56*a* and an outer side surface 56*b*.

Figure 5A:
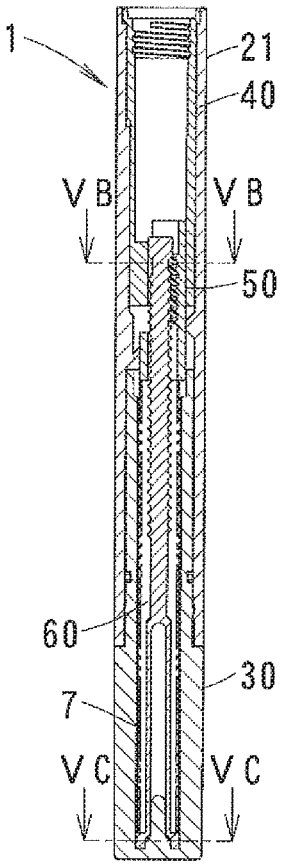
FIG. 5A is a front sectional view of the cartridge-type cosmetic container.
Figure 5B:
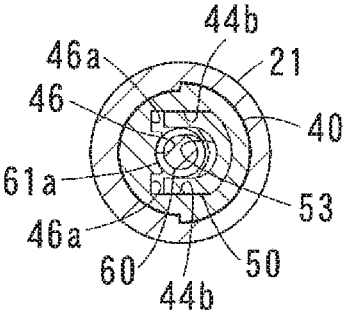
FIG. 5B is a sectional view along VB-VB in FIG. 5A.
Figure 5C:
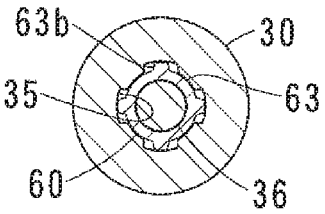
FIG. 5C is a sectional view along VC-VC in FIG. 5A.
Figure 6A:
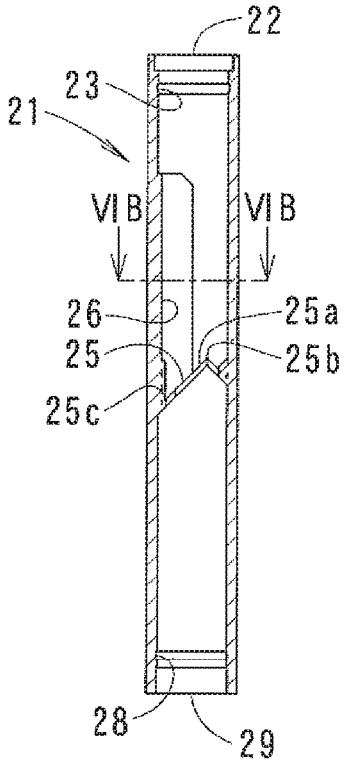
FIG. 6A is a front sectional view of a body outer tube.
Figure 6B:
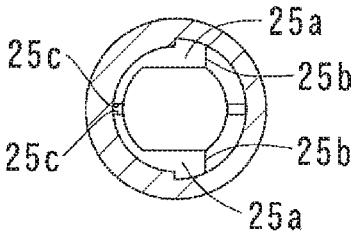
FIG. 6B is a sectional view along VIB-VIB in FIG. 6A.
Figure 7B:
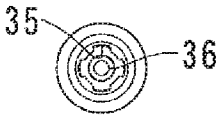
FIG. 7B is a plan view of the driving body.
Figure 7A:
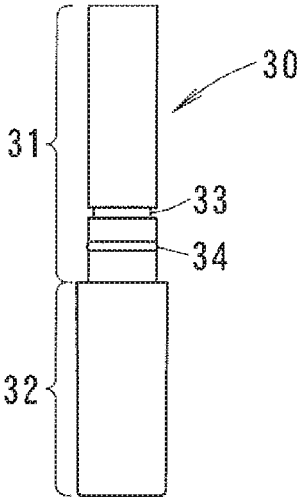
FIG. 7A is a front view of a driving body.
Figure 7C:
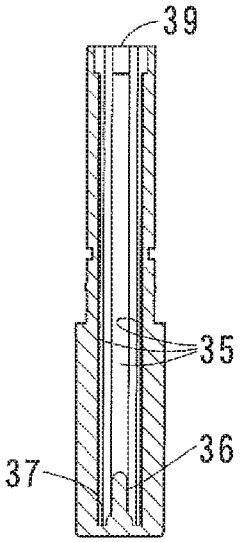
FIG. 7C is a front sectional view of the driving body.
Figure 8A:
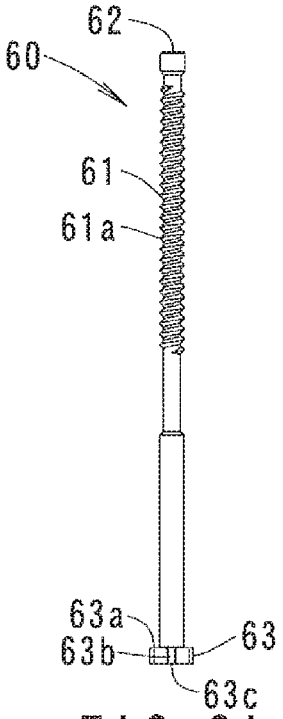
FIG. 8A is a front view of a push rod.
Figure 8C:
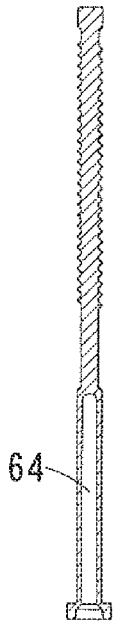
FIG. 8C is a front sectional view of the push rod.
Figure 8B:
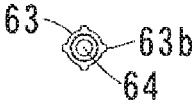
FIG. 8B is a bottom view of the push rod.
Figure 9:
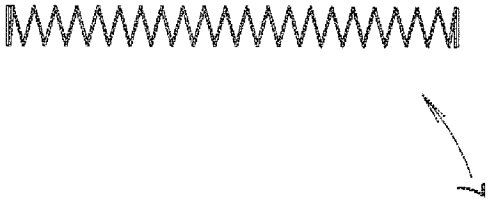
FIG. 9 is a front view of a coil spring.
Figure 10B:
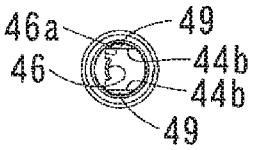
FIG. 10B is a plan view of the body inner tube.
Figure 10A:
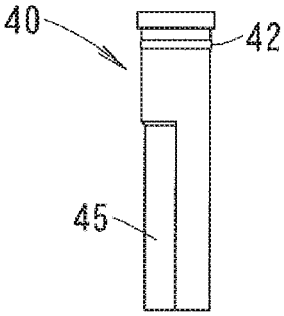
FIG. 10A is a front view of a body inner tube.
Figure 10D:
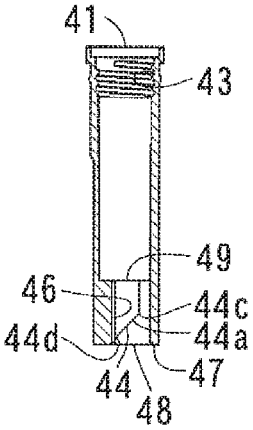
FIG. 10D is a front sectional view of the body inner tube.
Figure 10C:
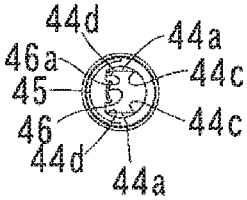
FIG. 10C is a bottom view of the body inner tube.
Figure 11B:
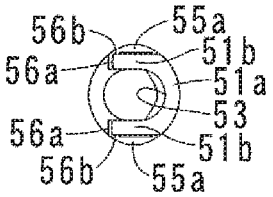
FIG. 11B is a plan view of the internal thread member.
Figure 11A:
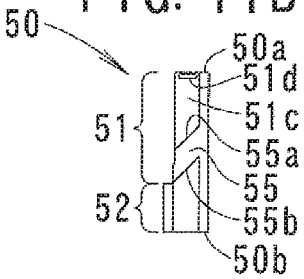
FIG. 11A is a front view of an internal thread member.
Figure 11D:
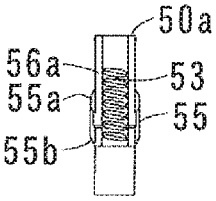
FIG. 11D is a side view of the internal thread member.
Figure 11E:
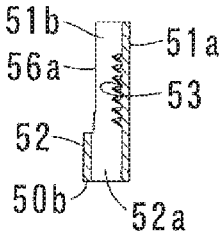
FIG. 11E is a front sectional view of the internal thread member.
Figure 11C:
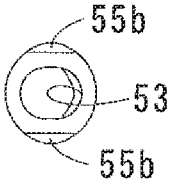
FIG. 11C is a bottom view of the internal thread member.

The outer side surface 56*b* of the extending portion 51*b* faces the side surface 44*b* of the separation guide portion 44 of the body inner tube 40 (see FIGS. 1C and 5B). In this way, relative rotation of the body inner tube 40 and the internal thread member 50 is disabled.

A tip part of the extending portion 51*b* is inserted into the recess 46*a* of the body inner tube 40 so that the opening end surface 56*a* faces the bottom surface of the recess 46*a* of the body inner tube 40 (see FIGS. 1C and 5B). The extending portion 51*b* has such a length that a predetermined clearance is formed between the opening end surface 56*a* and the bottom surface of the recess 46*a* with the base portion 51*a* held in contact with the inner peripheral surface of the body inner tube 40. That is, the internal thread member 50 is movable in the radial direction with respect to the body inner tube 40 within the range of this predetermined clearance in a state where the push rod 60 is not inserted in the inserting portion 52.

The hole 52*a* of the inserting portion 52 has a substantially elliptical cross-section and is formed such that a major axis of the substantially elliptical shape extends along the outer side surfaces 56*b* of the extending portions 51*b*. Thus, the internal thread member 50 is movable in the radial direction even in a state where the push rod 60 is inserted in the inserting portion 52.

Further, the internal thread member 50 includes protrusions 51*d* formed to project on the outer periphery of each extending portion 51*b*, the internal thread portion 53 formed on the inner periphery of the base portion 51*a* and the blade portions 55 formed to project on the outer periphery of each extending portion 51*b*.

The protrusions 51*d* are formed near the front end surface 50*a*. In a state where the biasing force of the coil spring 7 is not acting on the internal thread member 50, the protrusions 51*d* are placed on the step portions 49 of the body inner tube 40. In this way, the detachment of the internal thread member 50 from the body inner tube 40 can be prevented and the cartridge-type cosmetic container 1 is easily assembled.

The internal thread portion 53 is formed on the same lead as the lead of the external thread 61*a*. By the contact of the inner peripheral surface of the base portion 51*a* with the rod shaft 61, the internal thread portion 53 is threadably engaged with the external thread 61*a*. By relatively rotating the push rod 60 and the internal thread member 50 with the internal thread portion 53 and the external thread 61*a* threadably engaged, the push rod 60 moves forward and backward with respect to the internal thread member 50.

Since the body portion 51 is formed into a shape interrupted in the circumferential direction (shape not continuous in the circumferential direction) in the cartridge-type cosmetic container 1, an opening is formed between both end parts of the body portion 51 in the circumferential direction unlike a case where the body portion 51 is formed into a cylindrical shape as before. Thus, a mold for forming the internal thread portion 53 can be parted through the opening of the body portion 51 when the internal thread member 50 is molded, and such a mold needs not be twisted and removed while being rotated. Therefore, the internal thread member 50 can be more easily molded.

Further, since the body portion 51 of the internal thread member 50 is shaped to be interrupted in the circumferential direction and the inserting portion 52 has a substantially elliptical cross-section in the cartridge-type cosmetic container 1, the push rod 60 can be inserted into the inserting portion 52 with the external thread 61*a* separated from the internal thread portion 53. That is, the push rod 60 can be inserted into the inserting portion 52 without threadably engaging the external thread 61*a* and the internal thread portion 53. Thus, in assembling the internal thread member 50 with the rod shaft 61, the push rod 60 and the internal thread member 50 need not to be relatively rotated. Therefore, regardless of the size of the lead of the external thread 61*a*, the internal thread member 50 can be easily assembled with the rod shaft 61 even when the lead of the external thread 61*a* is small as in the present embodiment.

The blade portion 55 is inserted between the proximity guide portion 25 of the body outer tube 21 and the separation guide portion 44 of the body inner tube 40. That is, the blade portion 55 is provided with the front end surface 55*a* facing the inclined surface 44*a* of the separation guide portion 44 and the rear end surface 55*b* facing the inclined surface 25*a* of the proximity guide portion 25 with the cartridge-type cosmetic container 1 assembled.

In attaching the cartridge outer tube 10 to the body tube 20, the internal thread member 50 is pressed by the cartridge outer tube 10 and moves together with the cartridge outer tube 10 while compressing and contracting the coil spring 7. At this time, the rear end surfaces 55*b* of the blade portions 55 are slidably in contact with the inclined surfaces 25*a* of the proximity guide portions 25 of the body outer tube 21.

The inclined surface 25*a* of the proximity guide portion 25 is so inclined that an end part 25*b* of the internal thread member 50 on the side of the internal thread portion 53 is located closer to the front end opening 22 than an end part 25*c* on a side opposite to the internal thread portion 53 with respect to the push rod 60 with the cartridge-type cosmetic container 1 assembled. Thus, the internal thread member 50 is pressed by the cartridge outer tube 10 to move in the axial direction and guided to bring the internal thread portion 53 close to the external thread 61*a* when the cartridge outer tube 10 is attached to the body tube 10. As just described, the proximity guide portions 25 guide the internal thread member 50 in a direction to threadably engage the internal thread portion 53 and the external thread 61*a* when the cartridge outer tube 10 is attached to the body tube 20 and the internal thread member 50 is pressed by the cartridge outer tube 10.

By a movement of the internal thread member 50 in the direction to threadably engage the internal thread portion 53 and the external thread 61*a*, the inner peripheral surface of the base portion 51*a* of the internal thread member 50 contacts the rod shaft 61 of the push rod 60 and the internal thread portion 53 is threadably engaged with the external thread 61*a*. That is, the internal thread portion 53 is threadably engaged with the external thread 61*a* of the rod shaft 61 by the internal thread member 50 being pressed by the cartridge outer tube 10 when the cartridge outer tube 10 is attached to the body inner tube 40.

The projecting wall portion 46 of the body inner tube 40 is provided in a region facing the internal thread portion 53. The projecting wall portion 46 is in contact with the rod shaft 61 on a side opposite to the internal thread portion 53 in a state where the cartridge outer tube 10 is attached to the body tube 20 and the internal thread member 50 is guided by the proximity guide portions 25. Thus, the projecting wall portion 46 limits a movement of the push rod 60 in a direction to threadably disengage the internal thread portion 53 of the internal thread member 50 and the external thread 61*a* of the push rod 60 (hereinafter, also referred to as a "threadably disengaging direction").

Since the movement of the push rod 60 in the threadably disengaging direction is limited by the projecting wall portion 46, the rod shaft 61 is difficult to separate from the body portion 51 of the internal thread member 50 and the threadable engagement of the external thread 61*a* and the internal thread portion 53 is unlikely to be weakened. Thus, the push rod 60 more reliably moves forward and backward as the body tube 20 and the driving body 30 relatively rotate and the cosmetic 4 can be more reliably fed out from the cartridge outer tube 10.

The projecting wall portion 46 needs not be formed to be constantly in contact with the rod shaft 61 with the cartridge outer tube 10 attached to the body tube 20 and a gap may be formed between the projecting wall portion 46 and the rod shaft 61 with the internal thread portion 53 and the external thread 61*a* completely threadably engaged. This gap is formed to have such a size that the internal thread portion 53 and the external thread 61*a* are not threadably disengaged even if the rod shaft 61 moves in the threadably disengaging direction.

Further, since the projecting wall portion 46 is provided in the region facing the internal thread portion 53 in the cartridge-type cosmetic container 1, the rod shaft 61 hardly separates from the body portion 51 of the internal thread member 50 even if the push rod 60 is inclined with respect to a center axis of rotation. Thus, the threadable disengagement of the external thread 61*a* and the internal thread portion 53 can be prevented only by the projecting wall portion 46 of the body inner tube 40.

Since the body inner tube 40 of the body tube 20 includes the projecting wall portion 46 for limiting the movement of the push rod 60 in the threadably disengaging direction in the cartridge-type cosmetic container 1, a plurality of internal thread members 50 are not necessary in threadably engaging the internal thread portion 53 of the internal thread member 50 and the external thread 61*a* of the push rod 60. Since the coil spring 7 biases one internal thread member 50, a biasing force larger than normal does not act on the internal thread member 50 unlike in the case of using a plurality of internal thread members 50. Thus, even if a top part of the thread of the internal thread portion 53 of the internal thread member 50 abuts on a top part of the external thread 61*a* of the push rod 60, it does not become difficult to insert the cartridge outer tube 10 into the body tube 20. Therefore, the cartridge outer tube 10 can be inserted to a predetermined position in the body tube 20 and a movement of the push rod 60 in the threadably disengaging direction can be limited by the projecting wall portion 46. As a result, the push rod 60 more reliably moves forward and backward as the body tube 20 and the driving body 30 relatively rotate and the cosmetic 4 can be more reliably fed out from the cartridge outer tube 10.

Further, if a cartridge-type cosmetic container includes a plurality of internal thread members, one internal thread member may be shifted with respect to another internal thread member and the internal thread members may partially abut on each other. In such a case, a larger force than normal acts on a abutting part. Thus, it is difficult to simultaneously return the plurality of internal thread members to correct positions by a biasing force of a coil spring.

Since the cartridge-type cosmetic container 1 includes one internal thread member 50, a force larger than normal does not act on the internal thread member 50. Thus, even if the internal thread member 50 is inclined with respect to the axial direction, the internal thread member 50 can be returned to a correct position by the biasing force of the coil spring 7. Therefore, the cartridge outer tube 10 can be inserted to the predetermined position in the body tube 20 and the movement of the push rod 60 in the threadably disengaging direction can be limited by the projecting wall portion 46.

In detaching the cartridge outer tube 10 from the body tube 20, the internal thread member 50 is moved in the axial direction together with the cartridge outer tube 10 by the biasing force of the coil spring 7. At this time, the front end surfaces 55*a* of the blade portions 55 are slidably in contact with the inclined surfaces 44*a* of the separation guide portions 44 of the body inner tube 40.

The inclined surfaces 44*a* of the separation guide portions 44 are so inclined that an end part 44*c* of the internal thread member 50 on the side of the internal thread portion 53 is located closer to the front end opening 41 than an end part 44*d* on a side opposite to the internal thread portion 53 with respect to the push rod 60 with the cartridge-type cosmetic container 1 assembled. Thus, when the cartridge outer tube 10 is detached from the body tube 20, the internal thread member 50 is biased by the coil spring 7 to move in the axial direction and guided in a direction to separate the internal thread portion 53 from the external thread 61*a*. As just described, the separation guide portions 44 guide the internal thread member 50 in the direction to threadably disengage the internal thread portion 53 and the external thread 61*a* when the pressing of the internal thread member 50 by the cartridge outer tube 10 is released.

By separating the internal thread portion 53 from the external thread 61*a* and threadably disengaging the internal thread portion 53 and the external thread 61*a*, the push rod 60 is movable in the axial direction with respect to the internal thread member 50 by receiving a force regardless of relative rotation of the push rod 60 and the internal thread member 50. Thus, by detaching the cartridge outer tube 10 from the body tube 20, the push rod 60 can be easily moved to the feed lower limit.

In the cartridge-type cosmetic container 1, the coil spring 7 biases the push rod 60 in the direction to separate the large-diameter portion 63 from the internal thread member 50, i.e. in a direction toward the feed lower limit. Thus, with the cartridge outer tube 10 detached from the body tube 20 and the internal thread portion 53 and the external thread 61*a* threadably disengaged, the push rod 60 is moved in the direction toward the feed lower limit by the biasing force of the coil spring 7. Therefore, the push rod 60 can be more reliably moved to the feed lower limit.

Assembling procedures of the cartridge body 2 and the cartridge-type cosmetic container 1 are described below with reference to FIGS. 1A to 11E.

First, the assembling procedure of the cartridge body 2 is described.

The O-ring 5 is mounted into the O-ring groove 16 of the cartridge outer tube 10. Thereafter, the ceiling surface 71 of the holding member 70 is passed through the rear end opening 11*b* of the cartridge outer tube 10, and the holding member 70 is inserted into the inner periphery of the cartridge outer tube 10 by pressing the rear end surface 72 of the holding member 70.

When the rear end surface 72 of the holding member 70 is further pressed, the protrusion 73 of the holding member 70 moves over the annular projection 17*a* in the cartridge outer tube 10. At this time, the rear end surface 72 of the holding member 70 and the rear end surface 18 of the cartridge outer tube 10 are substantially flush with each other.

By the movement of the protrusion 73 of the holding member 70 over the annular projection 17*a* in the cartridge outer tube 10, the holding member 70 can be prevented from being detached from the rear end opening 11*b* of the cartridge outer tube 10 when the cartridge body 2 is attached to the cartridge-type cosmetic container 1 and when the cartridge body 2 is detached from the cartridge-type cosmetic container 1.

Subsequently, the melted cosmetic 4 is poured into the inner periphery of the cartridge outer tube 10 through the front end opening 11*a* of the cartridge outer tube 10 and the cosmetic 4 is cooled and solidified. The cosmetic 4 is formed into a gel or bar shape by being solidified.

Finally, the fitting recess 3*b* and the fitting projection 13*b* are fitted while the knurled part 3*a* of the cap 3 and the rib 13*a* of the cartridge outer tube 10 are engaged. By the fitting of the fitting recess 3*b* and the fitting projection 13*b*, the cap 3 is attached to the cartridge outer tube 10.

By the above procedure, the cartridge body 2 is completed.

Next, the assembling procedure of the cartridge-type cosmetic container 1 is described.

First, the front end surface 50*a* of the internal thread member 50 is passed through the rear end opening 48 of the body inner tube 40 and the internal thread member 50 is inserted into the inner periphery of the body inner tube 40. At this time, the recesses 46*a* of the body inner tube 40 and the extending portions 51*b* of the internal thread member 50 are so engaged that the bottom surfaces of the recesses 46*a* and the opening end surface 56*a* of the internal thread member 50 face each other.

When the internal thread member 50 is further inserted into the inner periphery of the body inner tube 40, the protrusions 51*d* of the internal thread member 50 move over the step portions 49 of the body inner tube 40. By inserting the internal thread member 50 into the body inner tube 40 until the protrusions 51*d* move over the step portions 49, the internal thread member 50 can be prevented from being detached from the rear end opening 48 of the body inner tube 40.

Subsequently, the rear end surface 47 of the body inner tube 40 assembled with the internal thread member 50 is passed through the front end opening 22 of the body inner tube 21 and the body inner tube 40 and the internal thread member 50 are inserted into the inner periphery of the body outer tube 21. At this time, the guide portion 45 of the body inner tube 40 and the guide wall portion 26 of the body outer tube 21 are aligned in position. When the body inner tube 40 is further inserted into the inner periphery of the body outer tube 21, the fitting recess 23 of the body outer tube 21 and the fitting projection 42 of the body inner tube 40 are fitted and the body inner tube 40 is assembled with the body outer tube 21.

By inserting the body inner tube 40 into the body outer tube 21, the blade portions 55 of the internal thread member 50 are arranged between the proximity guide portions 25 of the body outer tube 21 and the separation guide portions 44 of the body inner tube 40. Since the body tube 20 includes the body outer tube 21 and the body inner tube 40 accommodated in the body outer tube 21 and configured to rotate in synchronization with the body outer tube 21, the blade portions 55 of the internal thread member 50 can be easily arranged between the proximity guide portions 25 of the body outer tube 21 and the separation guide portions 44 of the body inner tube 40.

Subsequently, the push rod 60 is inserted into the inner periphery of the coil spring 7 from the ceiling surface 62 side of the rod shaft 60 and the coil spring 7 is placed on the coil spring placing portion 63*a* of the push rod 60. Thereafter, the push rod 60 is so inserted into the inner periphery of the driving body 30 that the support column 36 of the driving body 30 is inserted into the cavity portion 64 of the push rod 60. At this time, the ribs 63*b* of the large-diameter portion 63 and the grooves 35 of the driving body 30 are engaged.

The O-ring 6 may be mounted into the O-ring groove 33 of the driving body 30 before the push rod 60 is inserted into the inner periphery of the driving body 30 or after the push rod 60 is inserted into the inner periphery of the driving body 30.

Subsequently, the ceiling surface 62 of the push rod 60 and the tip of the driving body 30 are passed through the rear end opening 29 of the body outer tube 21 and the fitting portion 31 of the driving body 30 is inserted into the inner periphery of the body outer tube 21. By fitting the fitting projection 34 of the driving body 30 and the fitting recess 28 of the body outer tube 21, the driving body 30 is assembled with the body outer tube 21.

At this time, since the cartridge body 2 is not attached to the cartridge-type cosmetic container 1, the internal thread member 50 is separated from the proximity guide portions 25 of the body outer tube 21 and contacts the separation guide portions 44 of the body inner tube 40 due to the biasing force of the coil spring 7. The internal thread member 50 is guided in the direction to separate the internal thread portion 53 from the external thread 61*a* by the separation guide portions 44, and the internal thread portion 53 and the external thread 61*a* are not threadably engaged. Thus, the push rod 60 moves in the axial direction with respect to the internal thread member 50 by receiving a force, regardless of relative rotation of the push rod 60 and the internal thread member 50.

The push rod 60 is biased in a feed-back direction by the coil spring 7. Thus, the push rod 60 is accommodated in the inner peripheries of the body tube 20 and the driving body 30 with the rear end surface 63*c* thereof held in contact with the bottom surface 37 of the driving body 30, i.e. with the push rod 60 located at the feed lower limit.

By the above procedure, the cartridge-type cosmetic container 1 is completed.

Next, the procedure of attaching the cartridge body 2 to the cartridge-type cosmetic container 1 is described.

First, the rear end surface 18 of the cartridge outer tube 10 is passed through the front end opening 41 of the body inner tube 40, and the fitting portion 19 of the cartridge outer tube 10 is inserted into the inner periphery of the body inner tube 40. When the fitting portion 19 is inserted into the inner periphery of the body inner tube 40 while the external thread 15 of the cartridge outer tube 10 is threadably engaged with the internal thread 43 of the body inner tube 40, the rear end surface 18 of the cartridge outer tube 10 presses the front end surface 50*a* of the internal thread member 50.

The internal thread member 50 moves in the axial direction while compressing and contracting the coil spring 7. As a result, the front end surfaces 55*a* of the blade portions 55 of the internal thread member 50 are separated from the inclined surfaces 44*a* of the separation guide portions 44 of the body inner tube 40 and the rear end surfaces 55*b* of the blade portions 55 contact the inclined surfaces 25*a* of the proximity guide portions 25 of the body outer tube 21. Since the proximity guide portions 25 guide the internal thread member 50 in the direction to bring the internal thread portion 53 of the internal thread member 50 close to the external thread 61*a*, the internal thread portion 53 and the external thread 61*a* are threadably engaged.

Since the projecting wall portion 46 limits a movement of the push rod 60 in the threadably disengaging direction, the push rod 60 does not move even if the internal thread member 50 is brought close to the push rod 60 by the proximity guide portions 25 of the body outer tube 21 and the push rod 60 is pressed by the internal thread member 50. Thus, the threadable engagement of the external thread 61*a* and the internal thread portion 53 is unlikely to be weakened.

By relatively rotating the body tube 20 and the driving body 30 with the internal thread portion 53 and the external thread 61*a* threadably engaged, the push rod 60 rotates with respect to the internal thread member 50 and the push rod 60 moves forward with respect to the body tube 20. The rear end surface 72 of the holding member 70 of the cartridge body 2 is pressed by the ceiling surface 62 of the push rod 60 and the cosmetic 4 stored in the cartridge outer tube 10 is fed out from the front end opening 11*a*.

In the above way, the attachment of the cartridge body 2 to the cartridge-type cosmetic container 1 is completed.

Next, the procedure of detaching the cartridge body 2 from the cartridge-type cosmetic container 1 is described.

First, the cartridge outer tube 10 and the body tube 20 are relatively rotated to threadably disengage the external thread 15 of the cartridge outer tube 10 and the internal thread 43 of the body inner tube 40. By relative rotation of the cartridge outer tube 10 and the body tube 20, the cartridge body 2 is separated from the body tube 20. At this time, the internal thread member 50 is moved in the axial direction together with the cartridge body 2 by the biasing force of the coil spring 7.

When the internal thread member 50 is moved in the axial direction by the biasing force of the coil spring 7, the rear end surfaces 55*b* of the blade portions 55 of the internal thread member 50 are separated from the inclined surfaces 25*a* of the proximity guide portions 25 of the body outer tube 21 and the front end surfaces 55*a* of the blade portions 55 of the internal thread member 50 contact the inclined surfaces 44*a* of the separation guide portions 44 of the body inner tube 40. Since the separation guide portions 44 guide the internal thread member 50 in the direction to separate the internal thread portion 53 of the internal thread member 50 from the external thread 61*a*, the internal thread portion 53 and the external thread 61*a* are threadably disengaged.

When the internal thread portion 53 and the external thread 61*a* are threadably disengaged, the push rod 60 is moved in the direction toward the bottom surface 37 of the driving body 30 by the biasing force of the coil spring 7 to reach the feed lower limit. Thus, the cartridge-type cosmetic container 1 returns to a state where the push rod 60 is at the feed lower limit.

In the above way, the detachment of the cartridge body 2 from the cartridge-type cosmetic container 1 is completed.

According to the above first embodiment, the following effects are achieved.

Since the body tube 20 includes the projecting wall portion 46 for limiting the movement of the push rod 60 in the threadably disengaging direction in the cartridge-type cosmetic container 1, a plurality of internal thread members are not necessary in threadably engaging the internal thread portion 53 of the internal thread member 50 and the external thread 61*a* of the push rod 60. Since the coil spring 7 biases one internal thread member 50, a biasing force larger than normal does not act on the internal thread member 50 unlike in the case of using a plurality of internal thread members. Thus, even if the top part of the internal thread of the internal thread portion 53 of the internal thread member 50 abuts on the top part of the external thread 61*a* of the push rod 60, it does not become difficult to insert the cartridge body 2 into the body tube 20. Thus, the cartridge body 2 can be inserted to the predetermined positon in the body tube 20 and the movement of the push rod 60 in the threadably disengaging direction can be limited by the projecting wall portion 46. As a result, the push rod 60 can reliably move forward and backward as the body tube 20 and the driving body 30 relatively rotate, and the cosmetic 4 can be more reliably fed out from the cartridge body 2.

Further, by using one internal thread member 50, the cartridge-type cosmetic container 1 can be narrowed as compared to the case where a plurality of internal thread members are inserted into a body tube as before.

Further, a coil spring for biasing the push rod 60 and a coil spring for biasing the internal thread member 50 have been conventionally separately provided. However, since one coil spring 7 can bias the both in the present embodiment, the number of components can be reduced. Thus, assembling processes can be reduced and manufacturing cost can be reduced.

(Second Embodiment)

A cartridge-type cosmetic container 101 according to a second embodiment of the present invention is described below with reference to FIGS. 12A to 19F. It should be noted that the description of configurations similar to those of the aforementioned embodiment is omitted as appropriate in each of the following embodiments to avoid repeated description.

First, an entire configuration of the cartridge-type cosmetic container 101 is described with reference to FIGS. 12A to 12C and 13.

Figure 12A:
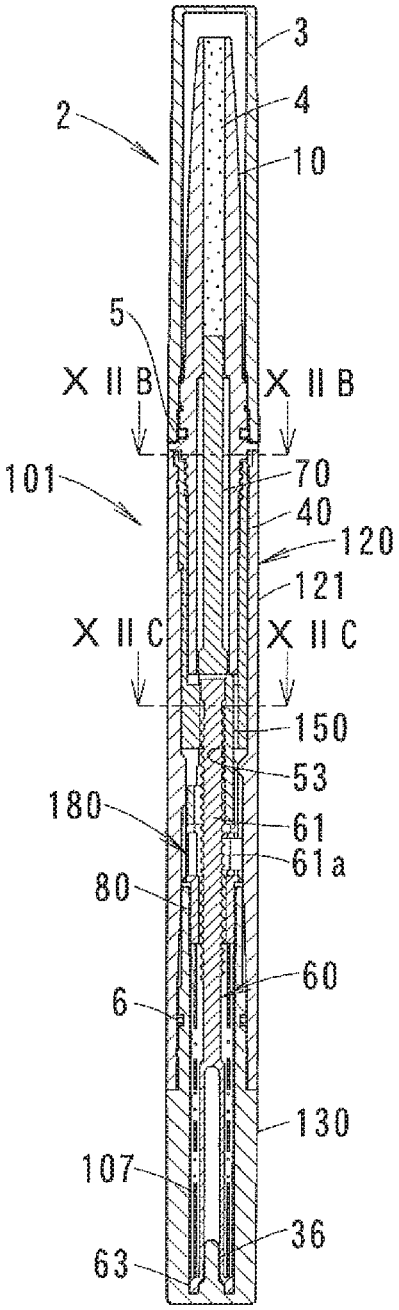
FIG. 12A is a front sectional view of a cartridge-type cosmetic container according to a second embodiment of the present invention.
Figure 12B:
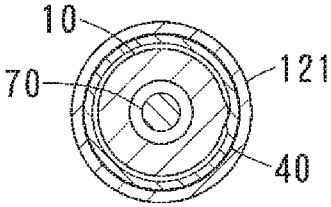
FIG. 12B is a sectional view along XIIB-XIIB in FIG. 12A.
Figure 12C:
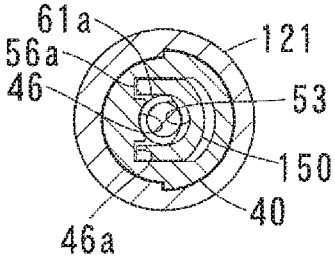
FIG. 12C is a sectional view along XIIC-XIIC in FIG. 12A.
Figure 13:
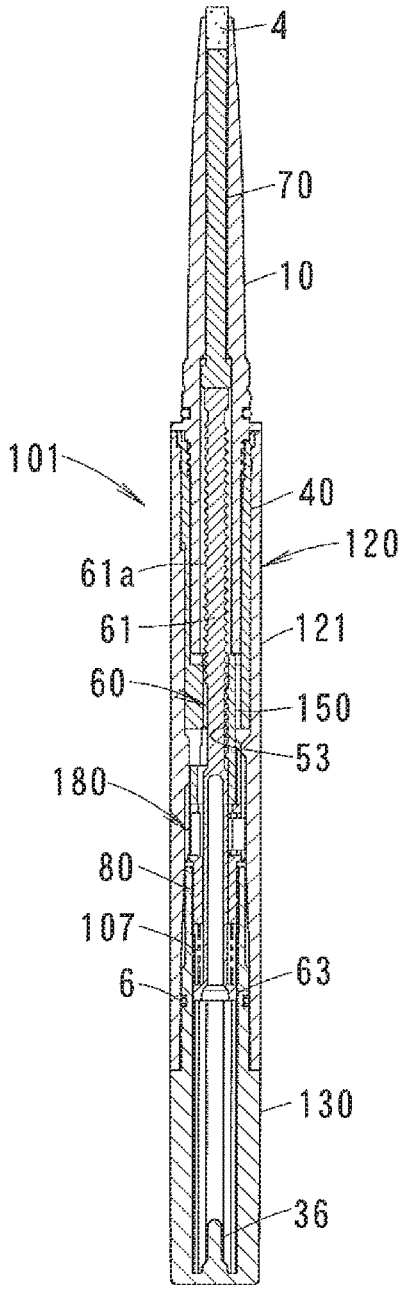
FIG. 13 is a front sectional view showing a feed upper limit of the cartridge-type cosmetic container according to the second embodiment of the present invention.
Figure 14A:
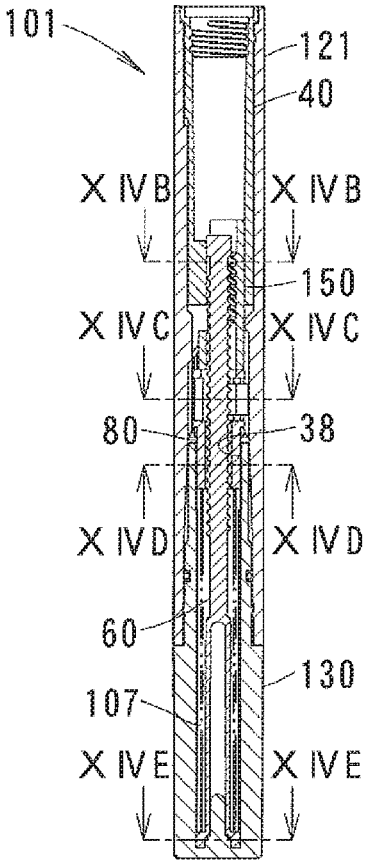
FIG. 14A is a front sectional view of the cartridge-type cosmetic container.
Figure 14B:
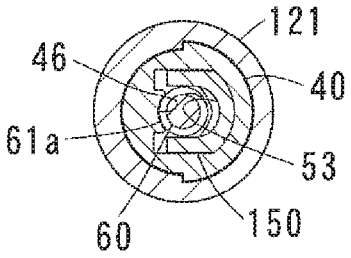
FIG. 14B is a sectional view along XIVB-XIVB in FIG. 14A.
Figure 14C:
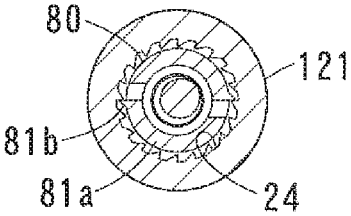
FIG. 14C is a sectional view along XIVC-XIVC in FIG. 14A.
Figure 14D:
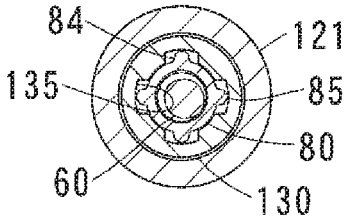
FIG. 14D is a sectional view along XIVD- XIVD in FIG. 14A.
Figure 14E:
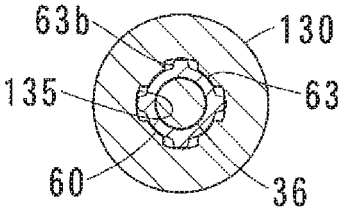
FIG. 14E is a sectional view along XIVE- XIVE in FIG. 14A.
Figure 15A:
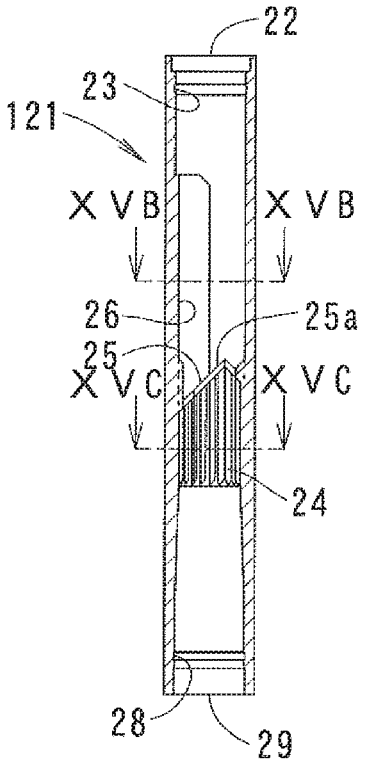
FIG. 15A is a front sectional view of a body outer tube.
Figure 15B:
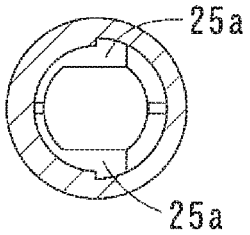
FIG. 15B is a sectional view along XVB-XVB in FIG. 15A.
Figure 15C:
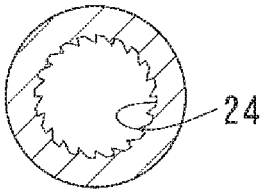
FIG. 15C is a sectional view along XVC-XVC in FIG. 15A.
Figure 16B:
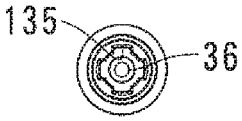
FIG. 16B is a plan view of the driving body.
Figure 16A:
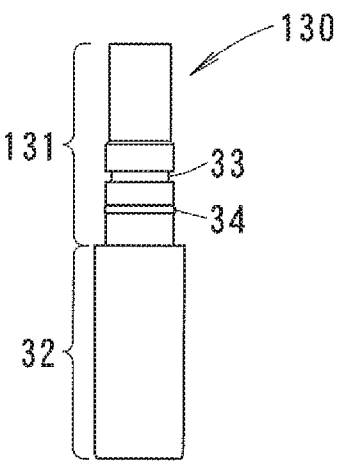
FIG. 16A is a front view of a driving body.
Figure 16C:
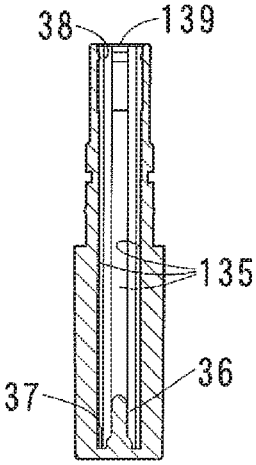
FIG. 16C is a front sectional view of the driving body.
Figure 17:
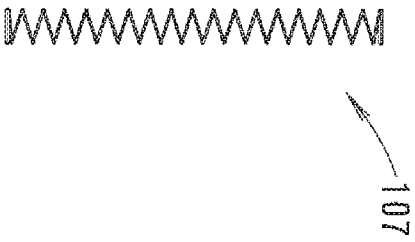
FIG. 17 is a front view of a coil spring.
Figure 18B:
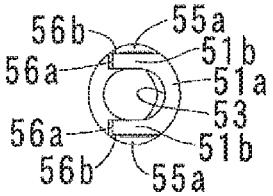
FIG. 18B is a plan view of the internal thread member.
Figure 18A:
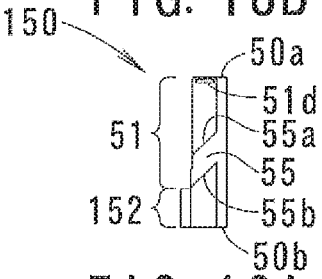
FIG. 18A is a front view of an internal thread member.
Figure 18D:
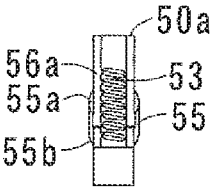
FIG. 18D is a side view of the internal thread member.
Figure 18E:
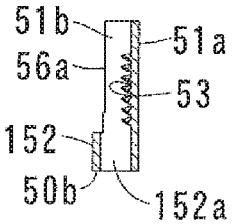
FIG. 18E is a front sectional view of the internal thread member.
Figure 18C:
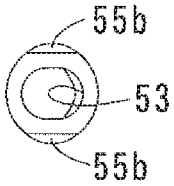
FIG. 18C is a bottom view of the internal thread member.
Figure 19D:
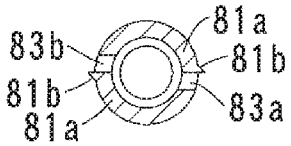
FIG. 19D is a sectional view along XIXD-XIXD in FIG. 19A.
Figure 19B:
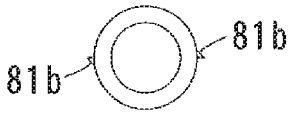
FIG. 19B is a plan view of the ratchet member.
Figure 19A:
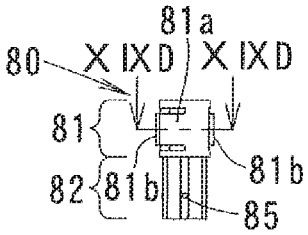
FIG. 19A is a front view of a ratchet member.
Figure 19E:
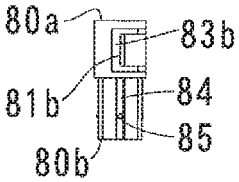
FIG. 19E is a side view of the ratchet member.
Figure 19F:
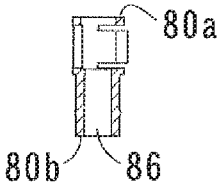
FIG. 19F is a front sectional view of the ratchet member.
Figure 19C:
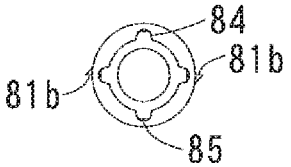
FIG. 19C is a bottom view of the ratchet member.
Figure 20A:
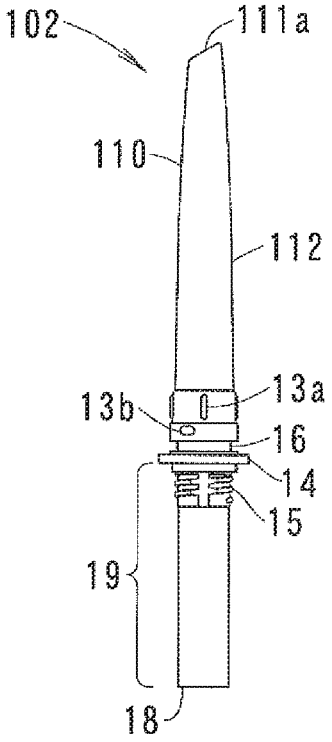
FIG. 20A is a front view of a modification of a cartridge body according to a third embodiment of the present invention.
Figure 20B:
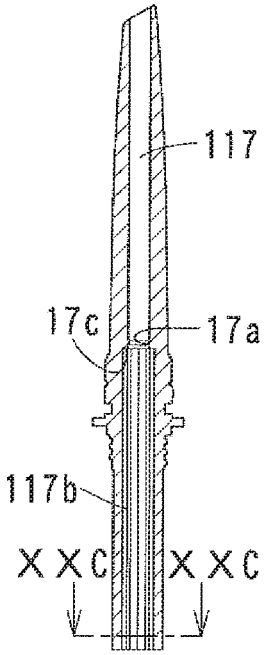
FIG. 20B is a front sectional view of a cartridge outer tube.
Figure 20D:
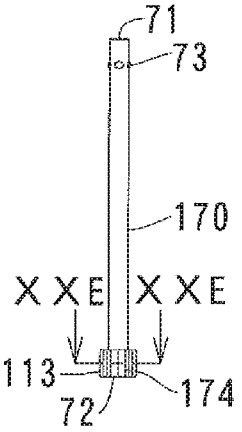
FIG. 20D is a front view of a holding member.
Figure 20C:
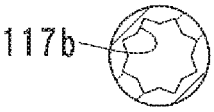
FIG. 20C is a sectional view along XXC-XXC in FIG. 20B.
Figure 20E:
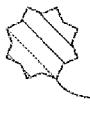
FIG. 20E is a sectional view along XXE-XXE in FIG. 20D.

The cartridge-type cosmetic container 101 is used with a cartridge body 2 attached thereto. As shown in FIGS. 12A to 12C, the cartridge-type cosmetic container 101 includes a body tube 120 to which the cartridge body 2 is detachably attached, a driving body 130 which is coaxially and relatively rotatably attached to the body tube 120, a push rod 60, an internal thread member 150 which is formed with an internal thread portion 53 on an inner periphery, and a coil spring 107 which serves as a biasing member for biasing the internal thread member 150 and the push rod 60. The body tube 120 includes a body outer tube 121 to which the driving body 130 is relatively rotatably attached, and a body inner tube 40 which is inserted into the inner periphery of the body outer tube 121.

The cartridge-type cosmetic 101 further includes a ratchet mechanism 180 for allowing relative rotation of the body tube 120 and the driving body 130 only in one direction. The ratchet mechanism 180 includes ratchet grooves 24 formed on the inner periphery of the body outer tube 121 and a ratchet member 80 to be relatively rotatably accommodated into the body outer tube 121. Each component for feeding out a cosmetic 4 is aggregated in the cartridge-type cosmetic container 101.

Since the structures of the cartridge body 2, the push rod 60 and the body inner tube 40 are the same as those of the cartridge body 2, the push rod 60 and the body inner tube 40 in the first embodiment, the description thereof is omitted here.

The cartridge-type cosmetic container 101 is described with reference to FIGS. 14A to 19F.

As shown in FIGS. 14A to 14E and 15A to 15C, the body outer tube 121 is formed into a substantially cylindrical shape having a front end opening 22 and a rear end opening 29. An annular fitting recess 23 is formed on the inner periphery near the front end opening 22. A fitting recess 28 is formed on the inner periphery near the rear end opening 29. Proximity guide portions 25 and a guide wall portion 26 are formed on the inner periphery of the body outer tube 121.

A plurality of ratchet grooves 24 are formed on the inner periphery of the body outer tube 121. The ratchet grooves 24 extend in an axial direction from the proximity guide portions 25 toward the rear end opening 29.

As shown in FIGS. 14A to 14E and 16A to 16C, the driving body 130 is formed into a bottomed substantially cylindrical shape. The driving body 130 includes a fitting portion 131 to be fitted into the body outer tube 121 and a grip portion 32 formed to be continuous with the fitting portion 131. The fitting portion 131 is formed into a substantially cylindrical shape. A fitting projection 34 and an O-ring groove 33 are formed on the outer periphery of the fitting portion 131.

Further, the driving body 130 is provided with a plurality of grooves 135 to be engaged with ribs 63*b* of a large-diameter portion 63 of the push rod 60, and a support column 36. The grooves 135 extend in the axial direction on the inner periphery of the driving body 130 from a bottom surface 37 of the inner periphery of the driving body 130 to a front end opening 139. The grooves 135 are engaged with the ribs 63*b* of the large-diameter portion 63 of the push rod 60, thereby disabling relative rotation of the push rod 60 and the driving body 130.

A protrusion 38 is formed on the inner surface of the groove 135 near the front end opening 139. A later-described protrusion 85 of the ratchet member 80 moves over the protrusion 38.

As shown in FIGS. 14A to 14E and 17, the coil spring 107 is arranged between a coil spring placing portion 63*a* and the ratchet member 80 such that a rod shaft 61 is inserted into the inner periphery of the coil spring 107. A free length of the coil spring 107 is longer than a distance between the coil spring placing portion 63*a* of the push rod 60 located at a feed lower limit and the ratchet member 80. Thus, with the cartridge-type cosmetic container 101 assembled, the coil spring 107 biases the push rod 60 and the ratchet member 80 in directions to separate the large-diameter portion 63 and the ratchet member 80 from each other.

As shown in FIGS. 14A to 14E and 18A to 18E, the internal thread member 150 includes a body portion 51 and an inserting portion 152 having a hole 152*a* through which the push rod 60 is inserted. A part of the inserting portion 152 is formed to be continuous in the axial direction from the body portion 51.

A biasing force of the coil spring 107 acts on a rear end surface (rear end surface of the inserting portion 152) 50*b* of the internal thread member 150 via the ratchet member 80. By the action of the biasing force of the coil spring 107 on the rear end surface 50*b*, the internal thread member 150 is biased in a direction to be separated from the large-diameter portion 63 of the push rod 60.

The rear end surface 50*b* of the internal thread member 150 is annularly formed. Thus, the biasing force of the coil spring 107 acts on the internal thread member 150 in an unbiased manner. Thus, the internal thread member 150 can be prevented from being inclined with respect to the axial direction.

The hole 152*a* of the inserting portion 152 has a substantially elliptical cross-section and is formed such that a major axis of the substantially elliptical shape extends along outer side surfaces 56*b* of extending portions 51*b*. Thus, the internal thread member 150 is movable in a radial direction even in a state where the rod shaft 61 is inserted in the in the hole 152*a*.

As shown in FIGS. 14A to 14E and 19A to 19F, the ratchet member 80 includes a body portion 81 to be accommodated into the inner periphery of the body outer tube 121 and a fitting portion 82 to be fitted into the driving body 130. The fitting portion 82 has a substantially cylindrical shape and is formed to be continuous in the axial direction from the body portion 81.

A plurality of ribs 84 extending in the axial direction from the body portion 81 to a rear end surface 80*b* and protrusions 85 formed to project on the tips of the ribs 84 are provided on the outer periphery of the fitting portion 82.

The ribs 84 are slidably engaged with the grooves 135 (see FIGS. 16A to 16C) of the driving body 130 to disable relative rotation of the driving body 130 and the ratchet member 80. Thus, if a user grips and rotates the driving body 130, the ratchet member 80 rotates in synchronization with the driving body 130. Since the ribs 84 are engaged with the grooves 135 extending in the axial direction, a movement of the ratchet member 80 in the axial direction with respect to the driving body 130 is not restrained.

The protrusions 85 are located on a side opposite to the front end opening 139 of the driving body 130 with respect to the protrusion 38 of the driving body 130 with the fitting portion 82 inserted in the driving body 130. Thus, if the ratchet member 80 moves in a direction to be detached from the driving body 130, the protrusion 85 of the ratchet member 80 locks the protrusion 38 of the driving body 130, thereby preventing the ratchet member 80 from coming off from the driving body 130.

The body portion 81 is shaped such that two substantially U-shaped slits 83*a*, 83*b* are formed side by side in a circumferential direction in a cylindrical side surface while being rotated by 90 [deg] with respect to the axial direction. A supporting portion 81*a* having an arcuate cross-section is formed inside (between two parts of each slit 83*a*, 83*b* extending in the circumferential direction) each substantially U-shaped slit 83*a*, 83*b*. The supporting portion 81*a* is fixed to the fitting portion 82 at one circumferential end part. Thus, if a radial force acts on the other end part of the supporting portion 81*a*, the supporting portion 81*a* is radially deflected with the one end part serving as a point of support.

A ratchet tooth 81*b* projecting radially outward is provided on the other end part of each supporting portion 81*a*. The supporting portion 81*a* is radially deflected, whereby the ratchet tooth 81*b* radially moves. If a radially inward force no longer acts on the other end part of the supporting portion 81*a*, the supporting portion 81*a* returns to an initial shape and the ratchet tooth 81*b* returns to an initial position.

The ratchet teeth 81*b* are engaged with the ratchet grooves 24 of the body outer tube 121 to allow relative rotation of the ratchet member 80 and the body outer tube 121 only in one direction. A direction in which relative rotation is allowed is referred to as a "rotation allowing direction" and a direction in which relative rotation is restrained is called a "rotation restraining direction" below.

The engagement of the ratchet teeth 81*b* and the ratchet grooves 24 of the body outer tube 121 is specifically described.

If it is tried to rotate the ratchet member 80 in the rotation allowing direction with respect to the body outer tube 121, inclined surfaces of the ratchet teeth 81*b* receive a radially inward force from inclined surfaces of the ratchet grooves 24 and the supporting portions 81*a* are deflected radially inwardly. By the deflection of the supporting portions 81*a*, the ratchet teeth 81*b* move radially inward and the inclined surfaces of the ratchet teeth 81*b* move over the inclined surfaces of the ratchet grooves 24. As a result, rotation in the rotation allowing direction is allowed.

If it is tried to rotate the ratchet member 80 in the rotation restraining direction with respect to the body outer tube 121, vertical surfaces of the ratchet teeth 81*b* contact vertical surfaces of the ratchet grooves 24. This impedes rotation in the rotation restraining direction.

As just described, the ratchet teeth 81*b* are engaged with the ratchet grooves 24 of the body outer tube 121 to allow relative rotation of the ratchet member 80 and the body outer tube 121 only in one direction. Since the ratchet grooves 24 extend in the axial direction, a movement of the ratchet member 80 in the axial direction is not restrained by the engagement of the ratchet teeth 81*b* of the ratchet grooves 24.

In the cartridge-type cosmetic container 101, the rotation allowing direction is a direction to relatively rotate the body tube 120 and the driving body 130 (ratchet member 80) to feed out the push rod 60, and the rotation restraining direction is a direction to relatively rotate the body tube 120 and the driving body 130 to feed back the push rod 60. Thus, even if the user tries to relatively rotate the body tube 120 and the driving body 130 in the direction to feed back the push rod 60, the body tube 120 and the driving body 130 do not relatively rotate. Therefore, the feed-back of the cosmetic 4 due to an erroneous operation can be prevented.

A front end surface (front end surface of the body portion 81) 80*a* of the ratchet member 80 abuts on the rear end surface 50*b* of the internal thread member 150. The coil spring 107 abuts on a rear end surface (rear end surface of the fitting portion 82) 80*b* of the ratchet member 80. That is, the biasing force of the coil spring 107 acts on the internal thread member 150 via the ratchet member 80.

The ratchet member 80 moves together with the cartridge outer tube 10 and the internal thread member 150 while compressing and contracting the coil spring 107 when the cartridge outer tube 10 is attached to the body tube 120. The ratchet member 80 is moved together with the cartridge outer tube 10 and the internal thread member 150 by the biasing force of the coil spring 107 when the cartridge outer tube 10 is detached from the body tube 120.

The ratchet member 80 is arranged on the inner periphery of the body outer tube 121 and arranged between the fitting portion 131 of the driving body 130 and the internal thread member 150.

An inner diameter of the body outer tube 121 in a region from the proximity guide portions 25 to the rear end opening 29 is smaller than an inner diameter of the body outer tube 21 in a corresponding region. This can ensure a depth of the ratchet grooves 24.

The fitting portion 131 of the driving body 130 is formed shorter than the fitting portion 31 of the driving body 30. Further, the inserting portion 152 of the internal thread member 150 is formed shorter than the inserting portion 52 of the internal thread member 50. Furthermore, the free length of the coil spring 107 is shorter than that of the coil spring 7. Thus, a dimension from the internal thread portion 53 of the internal thread member 150 to the bottom surface 37 of the driving body 130 is substantially equal to a corresponding dimension of the cartridge-type cosmetic container in the first embodiment. Therefore, the push rod 60 used in the first embodiment can also be used in the present embodiment.

An assembling procedure of the cartridge-type cosmetic container 101 is described with reference to FIGS. 12A to 19F. Since an assembling procedure of the cartridge body 2 is the same as in the first embodiment, the description thereof is omitted here.

The assembling procedure of the cartridge-type cosmetic container 101 is described.

First, as in the first embodiment, the body inner tube 40 is assembled with the internal thread member 150 and the body inner tube 40 assembled with the internal thread member 150 is assembled with the body outer tube 121.

Subsequently, the push rod 60 is inserted into the inner periphery of the coil spring 107 from the ceiling surface 62 side of the push rod 60, and the coil spring 107 is placed on the coil spring placing portion 63*a* of the push rod 60. Thereafter, the push rod 60 is so inserted into the inner periphery of the driving body 130 that the support column 36 of the driving body 130 is inserted into a cavity portion 64 of the push rod 60. At this time, the ribs 63*b* of the large-diameter portion 63 and the grooves 135 of the driving body 130 are engaged.

Subsequently, the ceiling surface 62 of the push rod 60 is passed through the rear end opening 86 of the ratchet member 80 and the push rod 60 is inserted into the ratchet member 80. With the push rod 60 inserted in the ratchet member 80, the rear end surface 80*b* of the ratchet member 80 is passed through the front end opening 139 of the driving body 130 and the fitting portion 82 of the ratchet member 80 is inserted into the driving body 130.

When the ratchet member 80 is inserted into the driving body 130 until the protrusion 85 of the ratchet member 80 moves over the protrusion 38 of the driving body 130, the ratchet member 80 is unlikely to be detached from the driving body 130 by locking between the protrusions 85 and 38. In this way, the coil spring 107 is sandwiched between the coil spring placing portion 63*a* of the push rod 60 and the rear end surface 80*b* of the ratchet member 80, whereby the coil spring 107 can be prevented from jumping out from the driving body 130.

Subsequently, the ceiling surface 62 of the push rod 60 and the front end surface 80*a* of the ratchet member 80 are passed through the rear end opening 29 of the body outer tube 121, and the push rod 60 and the ratchet member 80 are inserted into the inner periphery of the body outer tube 121. Further, the tip of the driving body 130 is passed through the rear end opening 29 of the body outer tube 121, and the fitting portion 131 of the driving body 130 is inserted into the inner periphery of the body outer tube 121 while the ratchet grooves 24 of the body outer tube 121 and the ratchet teeth 8 lb of the ratchet member 80 are engaged. By fitting the fitting projection 34 of the driving body 130 and the fitting recess 28 of the body outer tube 121, the driving body 130 is assembled with the body outer tube 121.

At this time, since the cartridge body 2 is not attached to the cartridge-type cosmetic container 1, the push rod 60 is accommodated in the inner peripheries of the body tube 120 and the driving body 130 while being located at the feed lower limit.

By the above procedure, the cartridge-type cosmetic container 101 is completed.

Next, the procedure of attaching the cartridge body 2 to the cartridge-type cosmetic container 101 is described.

When the fitting portion 19 of the cartridge outer tube 10 is inserted into the inner periphery of the body inner tube 40 while the external thread 15 of the cartridge outer tube 10 is threadably engaged with the internal thread 43 of the body inner tube 40, the rear end surface 18 of the cartridge outer tube 10 presses the front end surface 50*a* of the internal thread member 150 and the rear end surface 50*b* of the internal thread member 150 presses the front end surface 80*a* of the ratchet member 80.

The ratchet member 80 moves in the axial direction while compressing and contracting the coil spring 107. As a result, the internal thread member 150 moves in the axial direction.

By a movement of the internal thread member 150, the front end surfaces 55*a* of the blade portions 55 of the internal thread member 150 are separated from the inclined surfaces 44*a* of the separation guide portions 44 of the body inner tube 40 and the rear end surfaces 55*b* of the blade portions 55 contact the inclined surfaces 25*a* of the proximity guide portions 25 of the body outer tube 121. Since the proximity guide portions 25 guide the internal thread member 150 in a direction to bring the internal thread portion 53 of the internal thread member 150 close to the external thread 61*a*, the internal thread portion 53 and the external thread 61*a* are threadably engaged.

In the above way, the attachment of the cartridge body 2 to the cartridge-type cosmetic container 101 is completed.

Next, the procedure of detaching the cartridge body 2 from the cartridge-type cosmetic container 101 is described.

First, the cartridge outer tube 10 and the body tube 120 are relatively rotated to threadably disengage the external thread 15 of the cartridge outer tube 10 and the internal thread 43 of the body inner tube 40. By relative rotation of the cartridge outer tube 10 and the body tube 120, the cartridge body 2 is separated from the body tube 120. At this time, the internal thread member 150 is pressed by the ratchet member 80 biased by the coil spring 107 to move in the axial direction together with the cartridge body 2.

When the internal thread member 150 is moved in the axial direction by the biasing force of the coil spring 107, the rear end surfaces 55*b* of the blade portions 55 of the internal thread member 150 are separated from the inclined surfaces 25*a* of the proximity guide portions 25 of the body outer tube 121 and the front end surface 55*a* of the blade portions 55 of the internal thread member 150 contact the inclined surfaces 44*a* of the separation guide portions 44 of the body inner tube 40. Since the separation guide portions 44 guide the internal thread member 150 in the direction to separate the internal thread portion 53 of the internal thread member 150 from the external thread 61*a*, the internal thread portion 53 and the external thread 61*a* are threadably disengaged.

When the internal thread portion 53 and the external thread 61*a* are threadably disengaged, the push rod 60 is moved in a direction to be separated from the body tube 120 by the biasing force of the coil spring 107 and reaches the feed lower limit. Thus, the cartridge-type cosmetic container 101 returns to a state where the push rod 60 is located at the feed lower limit.

In the above way, the detachment of the cartridge body 2 from the cartridge-type cosmetic container 101 is completed.

According to the above second embodiment, effects similar to those of the first embodiment are achieved and the feed-back of the cosmetic 4 due to an erroneous operation can be prevented.

(Third Embodiment)

Hereinafter, a third embodiment of the present invention is described with reference to FIGS. 20A to 22C. A cartridge-type cosmetic container according to the present embodiment is the same as the cartridge-type cosmetic containers 1, 101 according to the first and second embodiments, and cartridge bodies 102, 202 and 302 to be attached to the cartridge-type cosmetic container differ from the cartridge body 2 according to the first embodiment. The cartridge bodies 102, 202 and 302 are described below.

As shown in FIGS. 20A to 20E, the cartridge body 102 includes a cartridge outer tube 110 having a through hole 117, a holding member 170 to be inserted into the through hole 117 and a cap 3 (see FIGS. 3A to 3D). The cartridge outer tube 110 includes a substantially cylindrical cosmetic storing portion 112 for storing a cosmetic.

A knurled part 117*b* extending in an axial direction from a rear end surface 18 to a step portion 17*c* is formed on the inner periphery of the cartridge outer tube 110. A large-diameter portion 113 is provided on the rear end of the holding member 170. Ribs 174 extending in the axial direction and to be engaged with the knurled part 117*b* are formed on the outer periphery of the large-diameter portion 113.

By the engagement of the ribs 174 with the knurled part 117*b*, relative rotation of the cartridge outer tube 110 and the holding member 170 is restricted. That is, a rotation restricting mechanism for restricting relative rotation of the cartridge outer tube 110 and the holding member 170 are formed by the ribs 174 and the knurled part 117*b*. Thus, even if a push rod 60 abutting on a rear end surface 72 of the holding member 170 rotates, the holding member 170 does not rotate with respect to the cartridge outer tube 110. Therefore, the cosmetic stored in the cosmetic storing portion 112 does not receive a rotational force of a ceiling surface 71 and can be prevented from rotating.

Since an assembling procedure of the cartridge body 102 is substantially the same as that of the cartridge body 2 according to the first embodiment, the description thereof is omitted here.

Figure 21A:
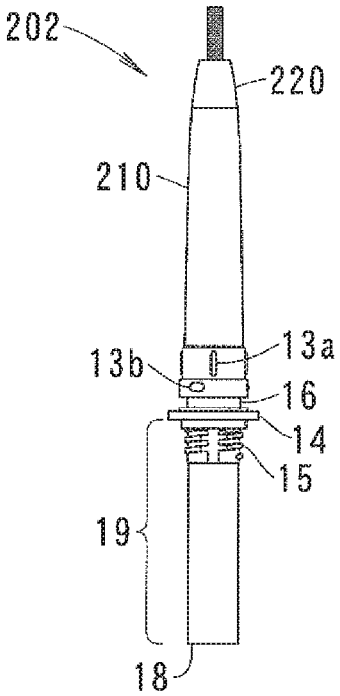
FIG. 21A is a front view of a modification of the cartridge body.
Figure 21B:
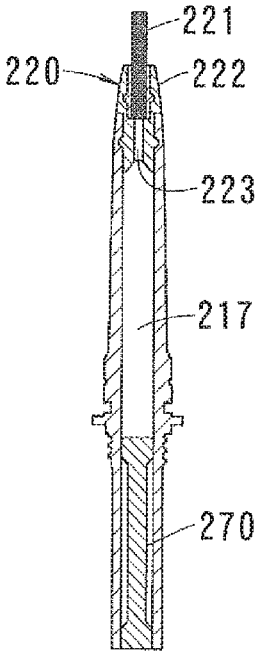
FIG. 21B is a front sectional view of the modification of the cartridge body.

As shown in FIGS. 21A and 21B, the cartridge body 202 includes a cartridge outer tube 210, a holding member 270 to be inserted into the cartridge outer tube 210, a brush member 220 to be attached to the tip of the cartridge outer tube 210 and a cap 3 (see FIGS. 3A to 3D). A storage portion 217 for storing a cosmetic in a liquid state is formed in the cartridge outer tube 210 by the holding member 270 and the brush member 220.

The brush member 220 includes a tip portion 221 formed by bundling a plurality of thread-like fibers and a holding portion 222 for holding the tip portion 221. A part of the holding portion 222 is fitted into the inner periphery of the cartridge outer tube 210.

The holding portion 222 is provided with a through hole 223 extending from the storage portion 217 to the tip portion 221. If the holding member 270 moves in a direction to contract the storage portion 217 as the push rod 60 is fed out, the cosmetic in the storage portion 217 is supplied to the tip portion 211 through the through hole 223.

Since an assembling procedure of the cartridge body 202 is substantially the same as that of the cartridge body 2 according to the first embodiment, the description thereof is omitted here.

Figures 22A, 22B, 22C:
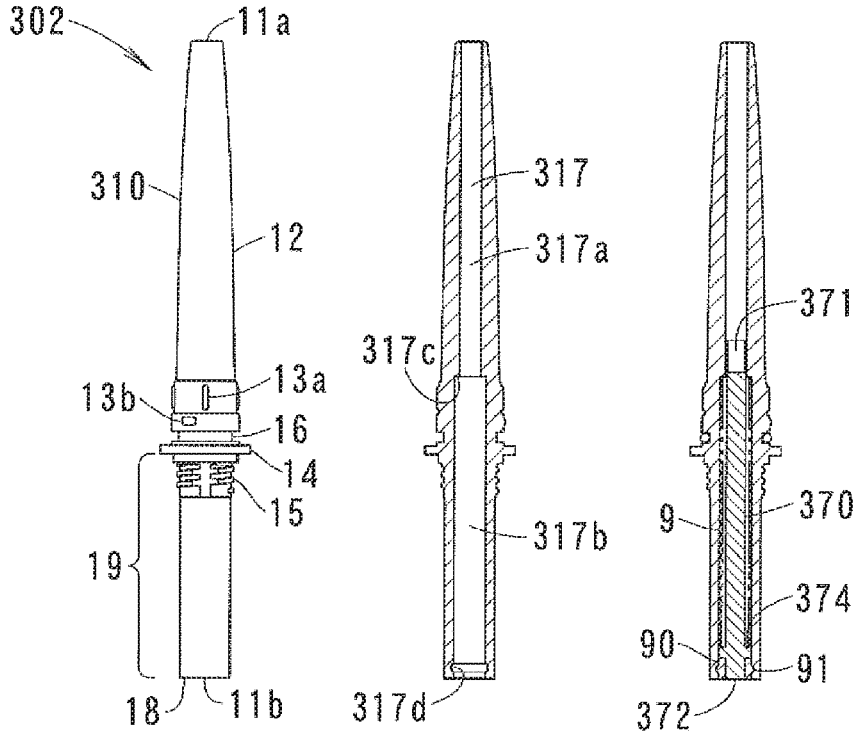
FIG. 22A is a front view of another modification of the cartridge body.
FIG. 22B is a front sectional view of the modification of the cartridge outer tube.
FIG. 22C is a front sectional view of the modification of the cartridge body.

As shown in FIGS. 22A to 22C, the cartridge body 302 includes a cartridge outer tube 310, a holding member 370 to be inserted into the cartridge outer tube 310, a coil spring 9 serving as a biasing member to be accommodated into the inner periphery of the cartridge outer tube 310, a tail plug 90 to be attached to the rear end of the cartridge outer tube 310 and a cap 3 (see FIGS. 3A to 3D).

A cup-like cosmetic inserting portion 371 is provided in a front end part of the holding member 370. A coil spring placing portion 374 on which the coil spring 9 is to be placed is provided near a rear end part of the holding member 370. The holding member 370 is so inserted into the inner periphery of the coil spring 9 that one end of the coil spring 9 abuts on the coil spring placing portion 374.

The through hole 317 of the cartridge outer tube 310 includes a first hole portion 317*a* formed from a front end opening 11*a* and a second hole portion 317*b* formed to be continuous from the first hole portion 317*a* to a rear end opening 11*b*. The second hole portion 317*b* is formed to have a larger diameter than the first hole portion 317*a*, and a step portion 317*c* is formed on a boundary between the first hole portion 317*a* and the second hole portion 317*b*.

The other end of the coil spring 9 abuts on the step portion 317*c* of the cartridge outer tube 310. Since the one end of the coil spring 9 abuts on the coil spring placing portion 374 of the holding member 370 inserted into the cartridge outer tube 310, the coil spring 9 biases the holding member 370 and the cartridge outer tube 310 in directions to separate the coil spring placing portion 374 of the holding member 370 and the step portion 317*c* from each other.

The coil spring placing portion 374 of the holding member 370 is located closer to a feed lower limit than the step portion 317*c* of the cartridge outer tube 310. That is, the coil spring 9 biases the holding member 370 in a direction toward the feed lower limit.

The tail plug 90 prevents the holding member 370 from coming out from the rear end opening 11*b* of the cartridge outer tube 310.

In the cartridge body 302, a rear end surface 372 of the holding member 370 is pressed by a ceiling surface 62 of the push rod 60 as the push rod 60 is fed out. By the pressing of the rear end surface 372, the holding member 370 moves toward the front end opening 11*a* while compressing and contracting the coil spring 9. As a result, the cosmetic inserted into the cosmetic inserting portion 371 is fed out from the front end opening 11*a*.

When the cartridge body 302 is detached from the body tube 20, 120, the push rod 60 moves to the feed lower limit and the rear end surface 372 is separated from the ceiling surface 62 of the push rod 60. As a result, the holding member 370 is moved toward the rear end opening 11*b* by the biasing force of the coil spring 9. When the tail plug 90 and the holding member 370 abut on each other, a movement of the holding member 370 is stopped. In this way, the holding member 370 can be fed back in the cartridge body 302.

Further, in the cartridge-type cosmetic container 1 (see the first embodiment), the body tube 20 and the driving body 30 can be relatively rotated to feed back the push rod 60. When the push rod is fed back, the cosmetic inserted into the cosmetic inserting portion 371 is fed back by the biasing force of the coil spring 9. That is, if the cartridge body 302 is fitted to the cartridge-type cosmetic container 1 and used, the cosmetic inserted into the cosmetic inserting portion 371 can be fed back with the cartridge body 302 fitted to the body tube 20.

Next, an assembling procedure of the cartridge body 302 is described.

First, the holding member 370 is inserted into the coil spring 9 from the cosmetic inserting portion 371 side of the holding member 370, and the coil spring 9 is placed on the coil spring placing portion 374. Thereafter, the cosmetic inserting portion 371 is passed through the rear end opening 11*b* of the cartridge outer tube 310, and the holding member 370 and the coil spring 9 are inserted into the inner periphery of the cartridge outer tube 310 by pressing the rear end surface 372 of the holding member 370. In this way, the coil spring 9 is sandwiched between the step portion 317*c* of the cartridge outer tube 310 and the coil spring placing portion 374 of the holding member 370.

Subsequently, the tail plug 90 is inserted into the inner periphery of the holding member 370 through the rear end opening 11*b* of the holding member 370, and a fitting projection 91 of the tail plug 90 and a fitting recess 317*d* of the cartridge outer tube 310 are fitted. In this way, the tail plug 90 is assembled with the cartridge outer tube 310 to prevent the holding member 370 from coming out from the cartridge outer tube 310.

Since the storage of the cosmetic and the attachment of the cap 3 are the same as with the cartridge body 2 according to the first embodiment, the description thereof is omitted.

By the above procedure, the cartridge body 302 is completed.

According to the above third embodiment, effects similar to those of the first and second embodiments are achieved.

Further, since relative rotation of the holding member 170 and the cartridge outer tube 110 is restrained in the cartridge body 102, it is possible to prevent the rotation of the cosmetic stored in the cosmetic storing portion 112 and prevent the breakage of the cosmetic.

The cartridge outer tube 110 may be used to store a cosmetic whose tip surface is inclined with respect to the axial direction. Since the front end surface of the cartridge outer tube 110 (peripheral edge of the front end opening 111*a*) is inclined with respect to the axial direction, the cartridge outer tube 110 is more suitable in storing such a cosmetic.

Further, the cosmetic whose tip surface is inclined with respect to the axial direction is preferably pushed out without being rotated so that a direction of inclination of the tip surface of the cosmetic is constant with respect to the cartridge outer tube 110. Since relative rotation of the holding member 170 and the cartridge outer tube 110 is restrained in the cartridge body 102, the cosmetic can be pushed out without being rotated. Thus, the cartridge body 102 is more suitable for the cosmetic whose tip surface is inclined with respect to the axial direction.

Since the storage portion 217 is formed by the cartridge outer tube 210, the holding member 270 and the brush member 220 in the cartridge body 202, the cartridge body 202 can cope with the cosmetic in the liquid state.

Since the coil spring 9 biases the holding member 370 in a feed-back direction in the cartridge body 302, the cosmetic can be fed back to the feed lower limit only by detaching the cartridge body 302 from the cartridge-type cosmetic container 1, 101.

Further, if the cartridge body 302 is fitted to the cartridge-type cosmetic container 1, in which the push rod 60 can be fed back, and used, the cosmetic inserted into the cosmetic inserting portion 371 can be fed back by the biasing force of the coil spring 9.

Embodiments of this invention were described above, but the above embodiments are merely examples of applications of this invention, and the technical scope of this invention is not limited to the specific constitutions of the above embodiments.

This application claims priority based on Japanese Patent Application No. 2015-157546 filed with the Japan Patent Office on Aug. 7, 2015, the entire contents of which are incorporated into this specification.

The invention claimed is:

1. A cartridge-type cosmetic container used with a cartridge body storing a cosmetic attached thereto, comprising:

a body tube to which the cartridge body is detachably attached;

a driving body relatively rotatably provided in the body tube;

a push rod formed with an external thread on an outer periphery, the push rod being configured to push out the cosmetic in the cartridge body by being fed out by relative rotation of the body tube and the driving body;

an internal thread member provided on an outer periphery of the push rod;

an internal thread portion formed in the internal thread member, the internal thread portion being configured to be threadably engaged with the external thread by pressing the internal thread member by the cartridge body when the cartridge body is attached to the body tube; and a biasing member configured to bias the internal thread member in a direction toward a front end opening of the body tube;

wherein the body tube includes a limiting portion configured to limit a movement of the push rod in a direction to threadably disengage the internal thread portion and the external thread, and the internal thread member moves relative to the limiting portion in a pressing direction by the cartridge body when the cartridge body is attached to the body tube.

2. The cartridge-type cosmetic container according to claim 1, wherein:

the internal thread member includes a body portion provided on a part of the outer periphery of the push rod;

the internal thread portion is formed in the body portion; and the limiting portion is provided in a region facing the internal thread portion.

3. The cartridge-type cosmetic container according to claim 1, wherein the limiting portion is a projecting wall portion projecting from an inner peripheral surface of the body tube.

4. The cartridge-type cosmetic container according to claim 1, further comprising:

a first guide portion provided on the body tube, the first guide portion being configured to guide the internal thread member in a direction to threadably engage the internal thread portion and the external thread when the internal thread member is pressed by the cartridge body.

5. The cartridge-type cosmetic container according to claim 4, further comprising a second guide portion provided on the body tube, the second guide portion being configured to guide the internal thread member, wherein:

the second guide portion guides the internal thread member in the direction to threadably disengage the internal thread portion and the external thread when the cartridge body is detached from the body tube and the internal thread member is moved by the biasing member;

the body tube includes a body outer tube and a body inner tube accommodated in the body outer tube, the body inner tube being configured to rotate in synchronization with the body outer tube;

the first guide portion is provided on the body outer tube; and the second guide portion is provided on the body inner tube.

6. The cartridge-type cosmetic container according to claim 1, further comprising a guide portion provided on the body tube, the guide portion being configured to guide the internal thread member, wherein the guide portion guides the internal thread member in the direction to threadably disengage the internal thread portion and the external thread when the cartridge body is detached from the body tube and the internal thread member is moved by the biasing member.

7. The cartridge-type cosmetic container according to claim 1, wherein:

the biasing member is configured to bias the push rod in a direction toward a feed lower limit.

8. The cartridge-type cosmetic container according to claim 1, wherein:

the internal thread member includes an inserting portion into which the push rod is inserted; and a biasing force of the biasing member acts on an end surface of the inserting portion.

9. The cartridge-type cosmetic container according to claim 1, further comprising:

a ratchet mechanism configured to allow relative rotation of the body tube and the driving body only in one direction.

10. The cartridge-type cosmetic container according to claim 9, wherein:

the ratchet mechanism includes:

a ratchet groove formed on an inner periphery of the body tube, the ratchet groove extending in an axial direction; and a ratchet member having a ratchet tooth to be inserted into the ratchet groove, the ratchet member being configured to rotate in synchronization with the driving body; and the biasing member biases the internal thread member via the ratchet member.

11. The cartridge-type cosmetic container according to claim 1, further comprising the cartridge body attached to the body tube, wherein:

the cartridge body includes:

a cartridge outer tube having a through hole, the cosmetic being stored in the through hole; and a holding member movably accommodated in the cartridge outer tube, the holding member being configured to hold the cosmetic;

the holding member is configured to push out the cosmetic in the cartridge body by being pressed by the push rod when the push rod is fed out.

12. The cartridge-type cosmetic container according to claim 11, wherein the cartridge body further includes a rotation restricting mechanism configured to restrict relative rotation of the cartridge outer tube and the holding member.

13. The cartridge-type cosmetic container according to claim 11, wherein the cartridge body further includes a feed-back biasing member configured to bias the holding member in a direction toward a feed lower limit.

14. The cartridge-type cosmetic container according to claim 1, wherein the limiting portion is configured to be contact with the push rod to limit the movement of the push rod.

* * * * *